US008794337B2

(12) United States Patent
Thomas et al.

(10) Patent No.: US 8,794,337 B2
(45) **Date of Patent: *Aug. 5, 2014**

(54) APPARATUS AND METHOD FOR CONTROLLING THE CONNECTION AND DISCONNECTION SPEED OF DOWNHOLE CONNECTORS

(75) Inventors: Phillip Terry Thomas, The Colony, TX (US); William Mark Richards, Flower Mound, TX (US); Bryon David Mullen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 361 days.

This patent is subject to a terminal disclaimer.

(21) Appl. No.: 13/405,269

(22) Filed: Feb. 25, 2012

(65) Prior Publication Data

US 2012/0181045 A1 Jul. 19, 2012

Related U.S. Application Data

(63) Continuation-in-part of application No. 12/372,862, filed on Feb. 18, 2009, now Pat. No. 8,122,967.

(51) Int. Cl.

| | |
|---|---|
| ***E21B 17/02*** | (2006.01) |
| ***E21B 47/12*** | (2012.01) |
| ***E21B 17/00*** | (2006.01) |

(52) U.S. Cl.

CPC ..... *E21B 17/003* (2013.01); *E21B 47/123* (2013.01); *E21B 17/023* (2013.01); *E21B 17/028* (2013.01); *E21B 17/021* (2013.01)

USPC ..... 166/380; 166/242.6; 166/242.7

(58) Field of Classification Search

USPC ..... 166/380, 381, 65.1, 242.6, 242.7

See application file for complete search history.

(56) References Cited

U.S. PATENT DOCUMENTS

| | | | |
|---|---|---|---|
| 4,690,212 | A | 9/1987 | Termohlen |
| 6,186,229 | B1 | 2/2001 | Martin et al. |

(Continued)

FOREIGN PATENT DOCUMENTS

| | | |
|---|---|---|
| GB | 2252422 | 8/1992 |
| WO | 2008027047 | 3/2008 |
| WO | 2009133474 | 11/2011 |

OTHER PUBLICATIONS

Jerry Greenberg; "Intelligent completions migrating to shallow water, lower cost wells"; Offshore; (Feb. 1999).

(Continued)

*Primary Examiner* — William P Neuder

(74) *Attorney, Agent, or Firm* — Lawrence R. Youst

(57) ABSTRACT

Apparatuses and methods for controlling the connection speed of downhole connectors in a subterranean well are disclosed. An apparatus includes a first assembly having a first downhole connector and a first communication medium that is positionable in the well. A second assembly includes a second downhole connector and a second communication medium and has an outer portion and an inner portion that are selectively axially shiftable relative to one another. A lock assembly including at least one lug initially couples the outer and inner portions of the second assembly together such that, upon engagement of the first assembly with the second assembly downhole, the lug is radially shifted releasing the lock assembly to allow axial shifting of the outer portion of the second assembly relative to the inner portion of the second assembly, thereby operatively connecting the first and second downhole connectors to enable communication between the communication media.

55 Claims, 28 Drawing Sheets

(56) References Cited

U.S. PATENT DOCUMENTS

| | | | | |
|---|---|---|---|---|
| 6,302,203 | B1 | 10/2001 | Rayssiguier et al. | |
| 6,390,193 | B1 | 5/2002 | Martin et al. | |
| 6,415,869 | B1 | 7/2002 | Smith | |
| 6,510,899 | B1 | 1/2003 | Sheiretov et al. | |
| 6,554,064 | B1 | 4/2003 | Restarick et al. | |
| 6,568,481 | B2 | 5/2003 | Koehler et al. | |
| 6,668,921 | B2 | 12/2003 | Koehler et al. | |
| 6,681,854 | B2 | 1/2004 | Danos | |
| 6,685,361 | B1 | 2/2004 | Rubino et al. | |
| 6,736,545 | B2 | 5/2004 | Cairns et al. | |
| 6,755,253 | B2 | 6/2004 | Smith et al. | |
| 6,776,636 | B1 | 8/2004 | Cameron et al. | |
| 6,789,621 | B2 | 9/2004 | Wetzel et al. | |
| 6,817,410 | B2 | 11/2004 | Wetzel et al. | |
| 6,873,267 | B1 | 3/2005 | Tubel et al. | |
| 6,983,796 | B2 | 1/2006 | Bayne et al. | |
| 7,052,185 | B2 | 5/2006 | Rubino et al. | |
| 7,063,143 | B2 | 6/2006 | Tilton et al. | |
| 7,104,324 | B2 | 9/2006 | Wetzel et al. | |
| 7,131,494 | B2 | 11/2006 | Bixenman et al. | |
| 7,165,892 | B2 | 1/2007 | Grigsby et al. | |
| 7,182,134 | B2 | 2/2007 | Wetzel et al. | |
| 7,182,617 | B1 | 2/2007 | Cairns et al. | |
| 7,191,832 | B2 | 3/2007 | Grigsby et al. | |
| 7,213,657 | B2 | 5/2007 | Vold et al. | |
| 7,222,676 | B2 | 5/2007 | Patel et al. | |
| 7,228,898 | B2 | 6/2007 | Grigsby et al. | |
| 7,252,437 | B2 | 8/2007 | Ringgenberg | |
| 7,398,822 | B2 | 7/2008 | Meijer et al. | |
| 7,558,093 | B1 | 7/2009 | Zheng | |
| 7,798,212 | B2 | 9/2010 | Bolze et al. | |
| 7,900,698 | B2 | 3/2011 | Stoesz | |
| 8,079,419 | B2 | 12/2011 | Richards | |
| 8,082,998 | B2 * | 12/2011 | Richards | 166/380 |
| 8,122,967 | B2 * | 2/2012 | Richards | 166/380 |
| 2003/0000875 | A1 | 1/2003 | Echols et al. | |
| 2005/0070144 | A1 | 3/2005 | Hall et al. | |
| 2006/0159400 | A1 | 7/2006 | Richards et al. | |
| 2006/0260818 | A1 | 11/2006 | Meijer et al. | |
| 2007/0140622 | A1 | 6/2007 | Kenison et al. | |
| 2008/0029274 | A1 | 2/2008 | Rytlewski et al. | |
| 2008/0047703 | A1 | 2/2008 | Stoesz et al. | |
| 2008/0302527 | A1 | 12/2008 | Coronado et al. | |
| 2008/0311776 | A1 | 12/2008 | Cox et al. | |
| 2009/0194275 | A1 | 8/2009 | Bissonnette et al. | |
| 2011/0108286 | A1 | 5/2011 | Richards | |
| 2011/0108287 | A1 | 5/2011 | Richards | |
| 2011/0108288 | A1 | 5/2011 | Richards | |

OTHER PUBLICATIONS

Russell Miller, et al; "Fiber optics, advanced technologies complete ERD producer/injector"; Oil & Gas Journal (1999).

Paulo Tubel; "Intelligent Systems for Optimized Reservoir Management and Improved Oil Recovery"; Weatherford-Sub Tech Intelligent Systems; (Aug. 1999).

International Search Report and Written Opinion (PCT/US2010/020030) International Searching Authority of the EPO, Mar. 11, 2011.

* cited by examiner

APPARATUS AND METHOD FOR CONTROLLING THE CONNECTION AND DISCONNECTION SPEED OF DOWNHOLE CONNECTORS

CROSS-REFERENCE TO RELATED APPLICATIONS

This is a continuation-in-part of application Ser. No. 12/372,862, filed Feb. 18, 2009, now U.S. Pat. No. 8,122,967, issued Feb. 28, 2012.

TECHNICAL FIELD OF THE INVENTION

This invention relates, in general, to equipment utilized and operations performed in conjunction with a subterranean well and, in particular, to an apparatus and method for controlling the connection and disconnection speed of downhole connectors.

BACKGROUND OF THE INVENTION

Without limiting the scope of the present invention, its background is described with reference to using optical fibers for communication and sensing in a subterranean wellbore environment, as an example.

It is well known in the subterranean well completion and production arts that downhole sensors can be used to monitor a variety of parameters in the wellbore environment. For example, during a treatment operation, it may be desirable to monitor a variety of properties of the treatment fluid such as viscosity, temperature, pressure, velocity, specific gravity, conductivity, fluid composition and the like. Transmission of this information to the surface in real-time or near real-time allows the operators to modify or optimize such treatment operations to improve the completion process. One way to transmit this information to the surface is through the use of an energy conductor which may take the form of one or more optical fibers.

In addition or as an alternative to operating as an energy conductor, an optical fiber may serve as a sensor. It has been found that an optical fiber may be used to obtain distributed measurements representing a parameter along the entire length of the fiber. Specifically, optical fibers have been used for distributed downhole temperature sensing, which provides a more complete temperature profile as compared to discrete temperature sensors. In operation, once an optical fiber is installed in the well, a pulse of laser light is sent along the fiber. As the light travels down the fiber, portions of the light are backscattered to the surface due to the optical properties of the fiber. The backscattered light has a slightly shifted frequency such that it provides information that is used to determine the temperature at the point in the fiber where the backscatter originated. In addition, as the speed of light is constant, the distance from the surface to the point where the backscatter originated can also be determined. In this manner, continuous monitoring of the backscattered light will provide temperature profile information for the entire length of the fiber.

Use of an optical fiber for distributed downhole temperature sensing may be highly beneficial during the completion process. For example, in a stimulation operation, a temperature profile may be obtained to determine where the injected fluid entered formations or zones intersected by the wellbore. This information is useful in evaluating the effectiveness of the stimulation operation and in planning future stimulation operations. Likewise, use of an optical fiber for distributed downhole temperature sensing may be highly beneficial during production operations. For example, during a production operation a distributed temperature profile may be used in determining the location of water or gas influx along the sand control screens. In a typical completion operation, a lower portion of the completion string including various tools such as sand control screens, fluid flow control devices, wellbore isolation devices and the like is permanently installed in the wellbore. The lower portion of the completion string may also include various sensors, such as a lower portion of the optical fiber. After the completion process is finished, an upper portion of the completions string which includes the upper portion of the optical fiber is separated from the lower portion of the completion string and retrieved to the surface. This operation cuts off communication between the lower portion of the optical fiber and the surface. Accordingly, if information from the production zones is to be transmitted to the surface during production operations, a connection to the lower portion of the optical fiber must be reestablished when the production tubing string is installed.

It has been found, however, that wet mating optical fibers in a downhole environment is very difficult. This difficulty is due in part to the lack of precision in the axially movement of the production tubing string relative to the previously installed completion string. Specifically, the production tubing string is installed in the wellbore by lowering the block at the surface, which is thousands of feet away from the downhole landing location. In addition, neither the distance the block is moved nor the speed at which the block is moved at the surface directly translates to the movement characteristics at the downhole end of the production tubing string due to static and dynamic frictional forces, gravitational forces, fluid pressure forces and the like. The lack of correlation between block movement and the movement of the lower end of the production tubing string is particularly acute in slanted, deviated and horizontal wells. This lack in precision in both the distance and the speed at which the lower end of the production tubing string moves has limited the ability to wet mate optical fibers downhole as the wet mating process requires relatively high precision to sufficiently align the fibers to achieve the required optical transmissivity at the location of the connection.

Therefore, a need has arisen for an apparatus and method for wet connecting optical fibers in a subterranean wellbore environment. A need has also arisen for such an apparatus and method for wet connecting optical fibers that is operable to overcome the lack of precision in the axial movement of downhole pipe strings relative to one another. Further, a need has arisen for such an apparatus and method for wet connecting optical fibers that is operable to overcome the lack of precision in the speed of movement of downhole pipe strings relative to one another.

SUMMARY OF THE INVENTION

The present invention disclosed herein is directed to an apparatus and method for wet connecting downhole communication media in a subterranean wellbore environment. The apparatus and method of the present invention are operable to overcome the lack of precision in the axial movement of downhole pipe strings relative to one another. In addition, the apparatus and method of the present invention are operable to overcome the lack of precision in the speed of movement of downhole pipe strings relative to one another. In carrying out the principles of the present invention, a wet connection apparatus and method are provided that are operable to control the connection speed of downhole connectors.

In one aspect, the present invention is directed to a method for controlling the connection speed of downhole connectors in a subterranean well. The method includes positioning a first assembly having a first downhole connector and a first communication medium in the well; engaging the first assembly with a second assembly, the second assembly including a second downhole connector and a second communication medium, the second assembly having an outer portion and an inner portion that are initially coupling together with a lock assembly; unlocking the outer portion of the second assembly from the inner portion of the second assembly by radially shifting at least one lug; axially shifting the outer portion of the second assembly relative to the inner portion of the second assembly; and operatively connecting the first and second downhole connectors, thereby enabling communication between the first and second communication media.

The method may also include, radially shifting a plurality of lugs of the lock assembly to unlock the outer portion of the second assembly from the inner portion of the second assembly; longitudinally shifting a plunger of the lock assembly responsive to contact with the first assembly to radially retract the at least one lug; radially retracting the at least one lug responsive to contact between at least one lug extension of the lock assembly and the first assembly; controlling an axial shifting speed of the outer portion of the second assembly relative to the inner portion of the second assembly with a resistance assembly by, for example, metering a fluid through a transfer piston; anchoring the second assembly within the first assembly by propping a key assembly of the second assembly within a profile of the first assembly; overcoming a biasing force of a spring operably associated with the transfer piston to control the axially shifting speed of the outer portion of the second assembly relative to the inner portion of the second assembly; resisting disconnection of the first and second downhole connectors by locking the outer portion of the second assembly with the inner portion of the second assembly by, for example, engaging a collet assembly of the outer portion of the second assembly with a shoulder of the inner portion of the second assembly by continuing the axial shifting of the outer portion of the second assembly relative to the inner portion of the second assembly after connecting the first and second downhole connectors; and/or selecting the communication media from the group consisting of optical fibers, electrical conductors and hydraulic fluid.

In another aspect, the present invention is directed to an apparatus for controlling the connection speed of downhole connectors in a subterranean well. The apparatus includes a first assembly having a first downhole connector and a first communication medium that is positionable in the well. A second assembly includes a second downhole connector and a second communication medium and has an outer portion and an inner portion that are selectively axially shiftable relative to one another. A lock assembly including at least one lug initially couples the outer and inner portions of the second assembly together such that, upon engagement of the first assembly with the second assembly, the at least one lug is radially shifted releasing the lock assembly to allow axial shifting of the outer portion of the second assembly relative to the inner portion of the second assembly, thereby operatively connecting the first and second downhole connectors to enable communication between the communication media.

In one embodiment, the lock assembly includes a plurality of lugs. In another embodiment, the lock assembly includes a plunger assembly that longitudinally shifts relative to the at least one lug responsive to contact with the first assembly to radially retract the at least one lug. In a further embodiment, the lock assembly includes at least one lug extension that radially retracts the at least one lug responsive to contact between the at least one lug extension and the first assembly. In certain embodiments, a resistance assembly is positioned between the outer portion of the second assembly and the inner portion of the second assembly that controls the axial shifting speed of the outer and inner portions of the second assembly relative to one another. In such embodiments, the resistance assembly may include a transfer piston operable to have fluid metered therethrough and a spring operably associated with the transfer piston. In one embodiment, the second assembly includes a key assembly and the first assembly includes a profile such that the key assembly may be propped within the profile to anchor the second assembly within the first assembly. In another embodiment, the inner portion of the second assembly may include a shoulder and the outer portion of the second assembly may include a collet assembly. In this embodiment, continued axial shifting of the outer portion of the second assembly relative to the inner portion of the second assembly after connecting the first and second downhole connectors engages the collet assembly with the shoulder to selectively lock the outer portion of the second assembly with the inner portion of the second assembly to resist disconnection of the first and second downhole connectors. In certain embodiments, the communication media are selected from the group consisting of optical fibers, electrical conductors and hydraulic fluid conductor.

In a further aspect, the present invention is directed to a method for controlling the connection speed of downhole connectors in a subterranean well. The method includes positioning a first assembly having a first downhole connector and a first communication medium in the well; engaging the first assembly with a second assembly having a second downhole connector and a second communication medium; unlocking an outer portion of the second assembly from an inner portion of the second assembly by radially shifting at least one lug; axially shifting the outer portion of the second assembly relative to the inner portion of the second assembly while metering a fluid through a transfer piston to control the axially shifting speed thereof; and operatively connecting the first and second downhole connectors, thereby enabling communication between the first and second communication media.

In yet another aspect, the present invention is directed to an apparatus for controlling the connection speed of downhole connectors in a subterranean well. The apparatus includes a first assembly having a first downhole connector and a first communication medium that is positionable in the well. A second assembly includes a second downhole connector and a second communication medium. The second assembly has an outer portion and an inner portion with a transfer piston positioned therebetween. The outer portion is selectively axially shiftable relative to the inner portion. A lock assembly including at least one lug initially couples the outer and inner portions of the second assembly together such that, upon engagement of the first assembly with the second assembly, the at least one lug is radially shifted to release the lock assembly and allow axial shifting of the outer portion of the second assembly relative to the inner portion of the second assembly while a fluid is metered through the transfer piston to control the speed at which the outer and inner portions of the second assembly axially shift relative to one another such that the first and second downhole connectors are operatively connected at a predetermined connection speed, thereby enabling communication between the communication media.

In an additional aspect, the present invention is directed to a method for controlling the connection speed of downhole connectors in a subterranean well. The method includes positioning a first assembly having a first downhole connector and a first communication medium in the well; engaging the first assembly with a second assembly, the second assembly including a second downhole connector and a second communication medium, the second assembly having an outer portion and an inner portion that are initially coupling together; unlocking the outer portion of the second assembly from the inner portion of the second assembly responsive to contact with the first assembly; axially shifting the outer portion of the second assembly relative to the inner portion of the second assembly; operatively connecting the first and second downhole connectors, thereby enabling communication between the first and second communication media; and resisting disconnection of the first and second downhole connectors by recoupling the outer portion of the second assembly with the inner portion of the second assembly.

In another additional aspect, the present invention is directed to an apparatus for controlling the connection speed of downhole connectors in a subterranean well. The apparatus includes a first assembly having a first downhole connector and a first communication medium that is positionable in the well. A second assembly includes a second downhole connector and a second communication medium. The second assembly has an outer portion and an inner portion that are selectively axially shiftable relative to one another. A first lock assembly initially couples the outer and inner portions of the second assembly together. A second lock assembly is operable to recouple the outer and inner portions of the second assembly together. In operation, upon engagement of the first assembly with the second assembly, the first lock assembly is released to allow axial shifting of the outer portion of the second assembly relative to the inner portion of the second assembly in a first direction which operatively connects the first and second downhole connectors, thereby enabling communication between the communication media. Thereafter, continued axial shifting of the outer portion of the second assembly relative to the inner portion of the second assembly in the first direction engages the second lock assembly thereby recoupling the outer portion of the second assembly with the inner portion of the second assembly to resist disconnection of the first and second downhole connectors.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
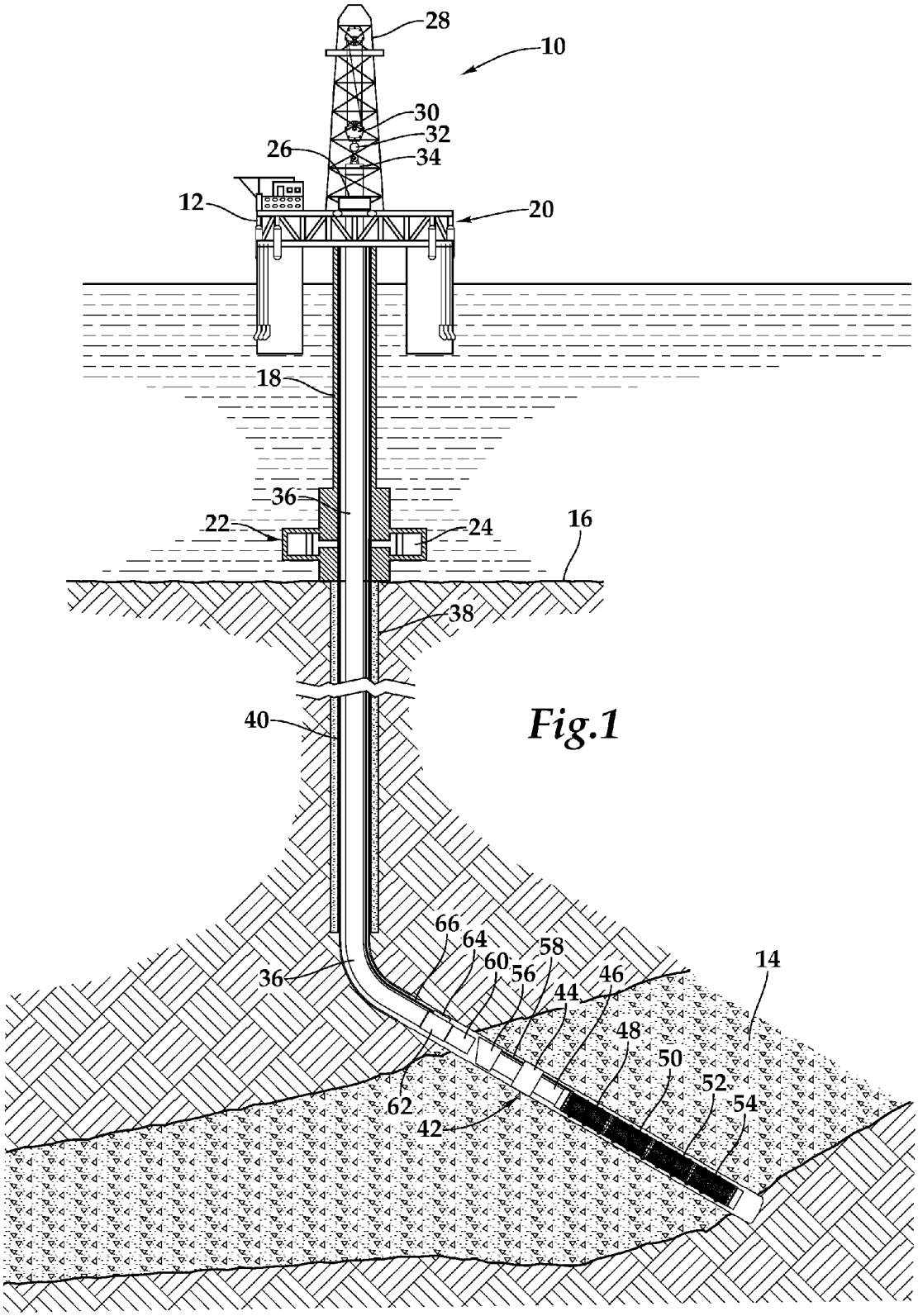
FIG. 1 is a schematic illustration of an offshore oil and gas platform operating an apparatus for controlling the connection speed of downhole connectors according to an embodiment of the present invention.
Figure 2A:
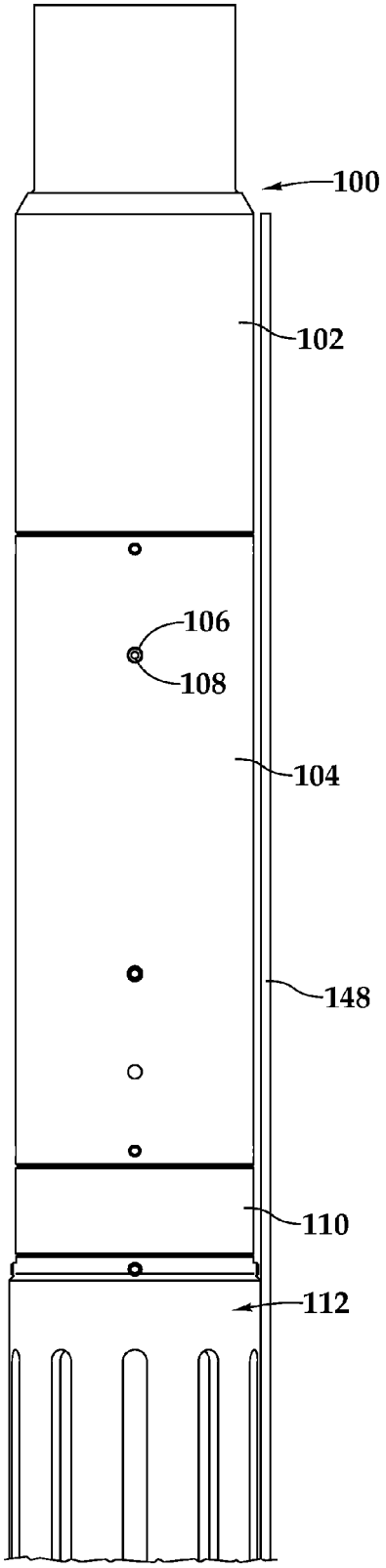
FIGS. 2A-2D are front views of consecutive axial sections of an apparatus for controlling the connection speed of downhole connectors in a running configuration according to an embodiment of the present invention.
Figure 3A:
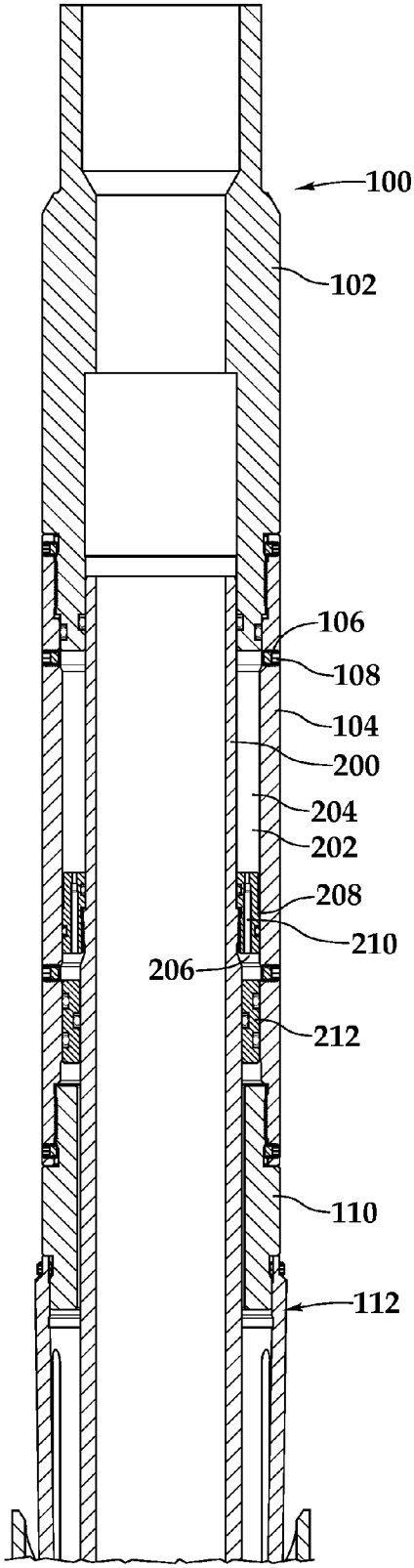
FIGS. 3A-3D are cross sectional views of consecutive axial sections of an apparatus for controlling the connection speed of downhole connectors in a running configuration according to an embodiment of the present invention.
Figure 2B:
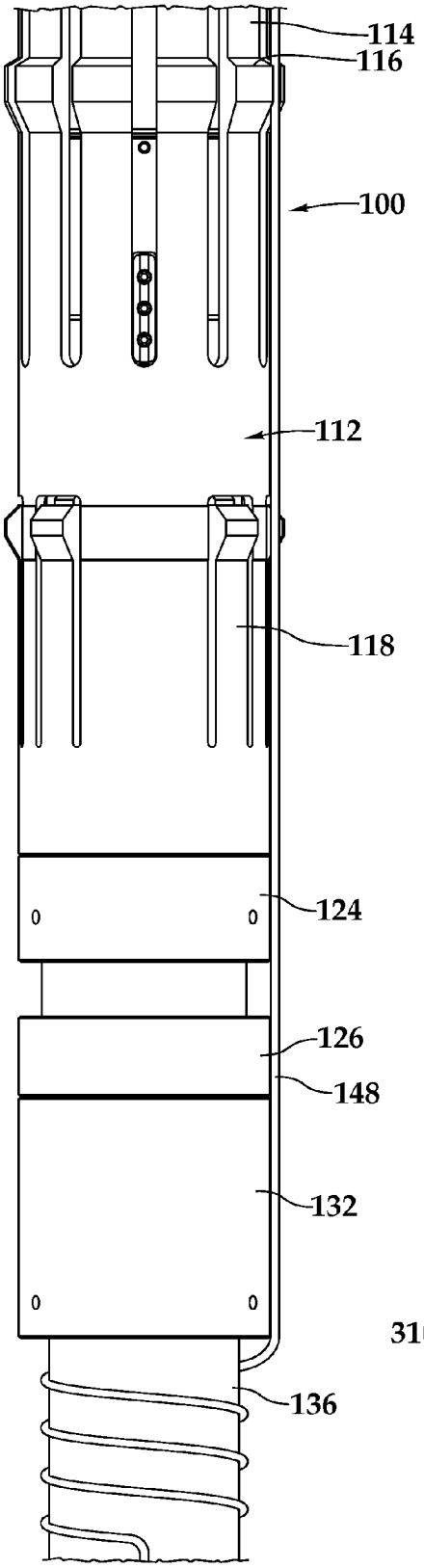
Figure 3B:
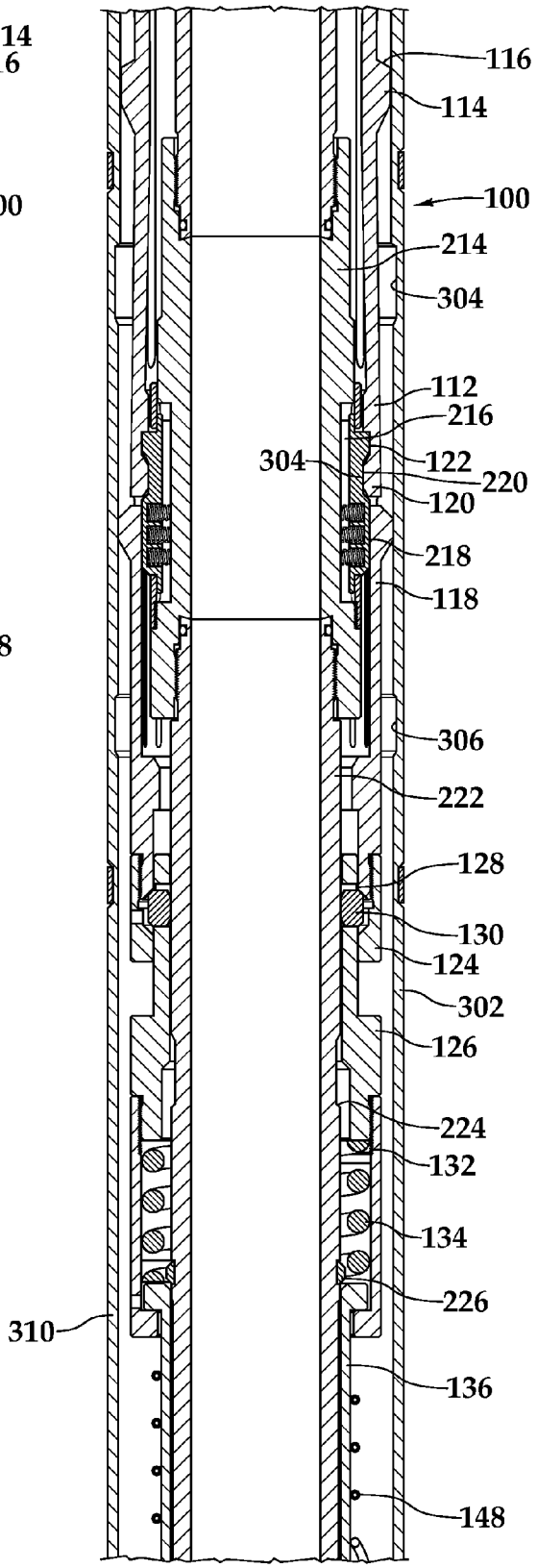
Figure 2C:
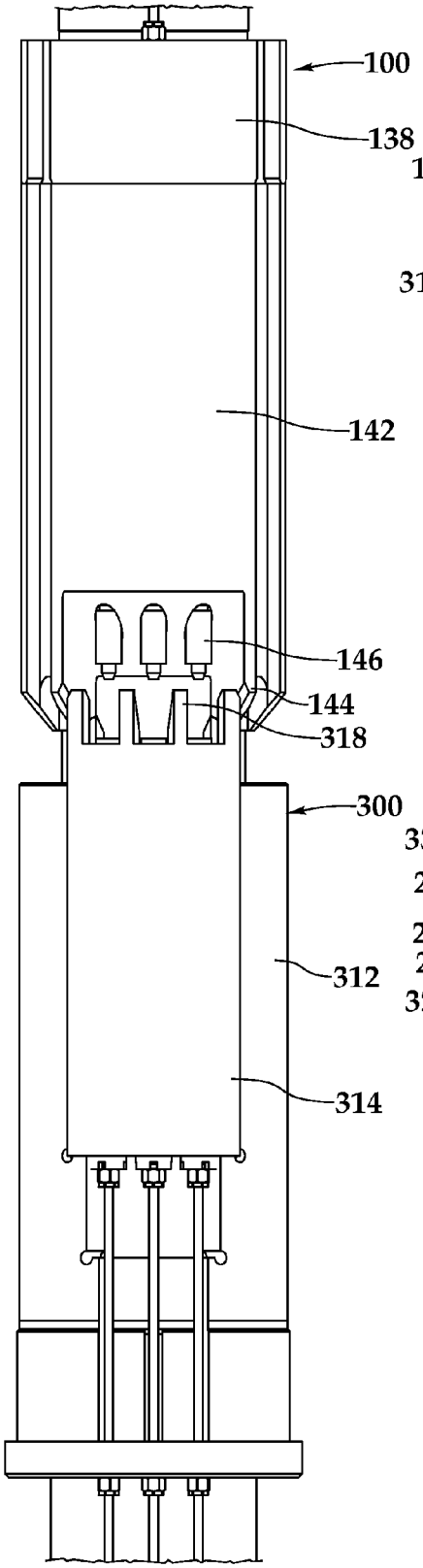
Figure 3C:
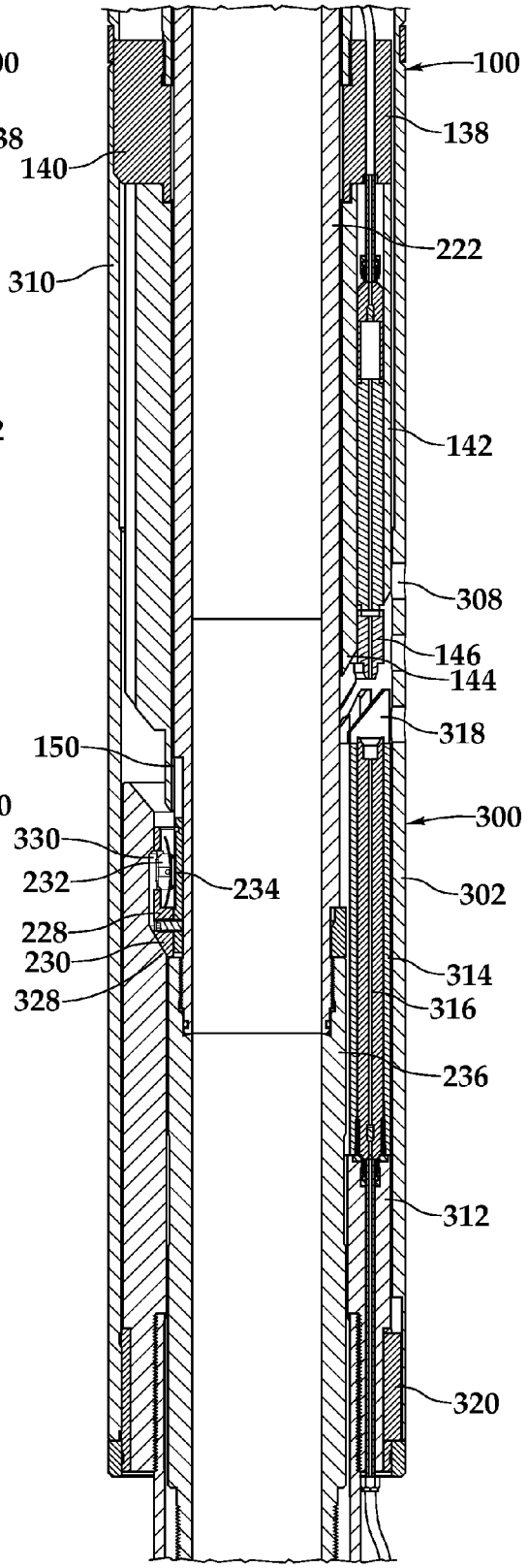
Figure 2D:
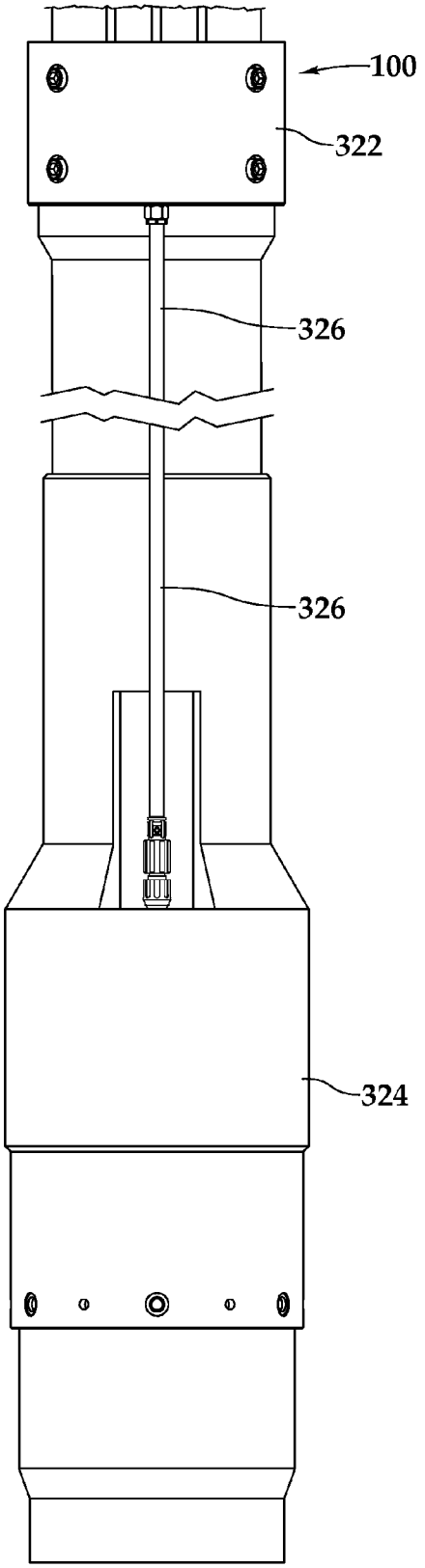
Figure 3D:
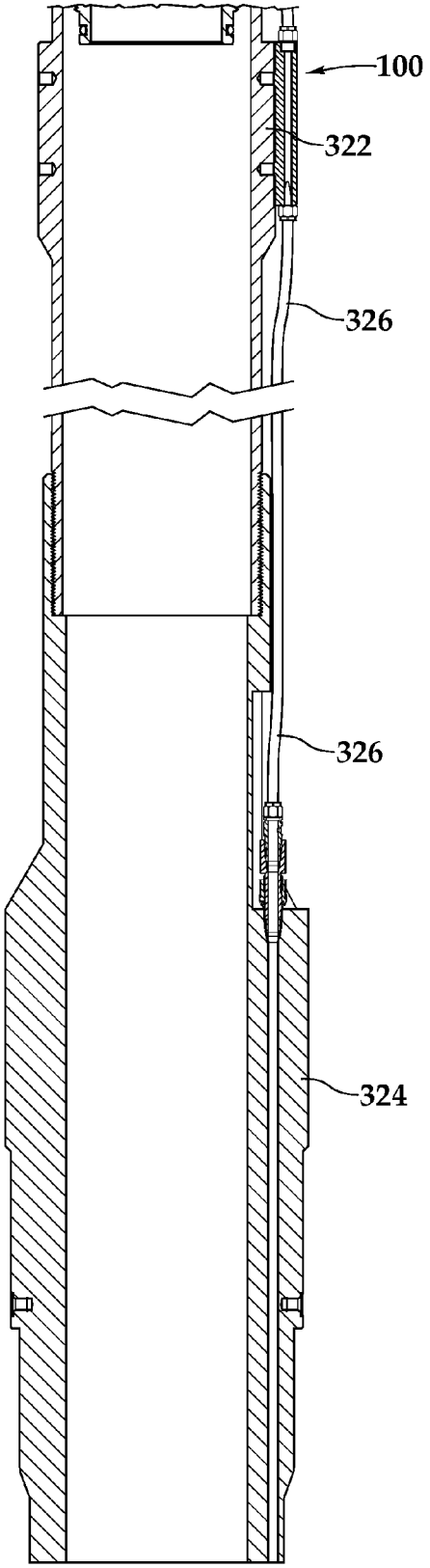
Figure 4A:
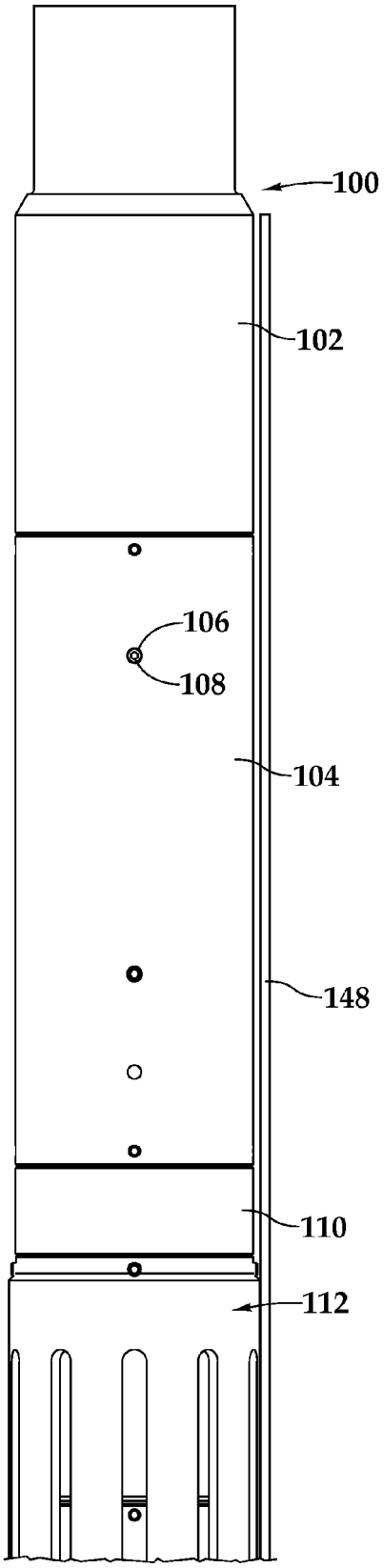
FIGS. 4A-4D are front views of consecutive axial sections of an apparatus for controlling the connection speed of downhole connectors in an anchored configuration according to an embodiment of the present invention.
Figure 5A:
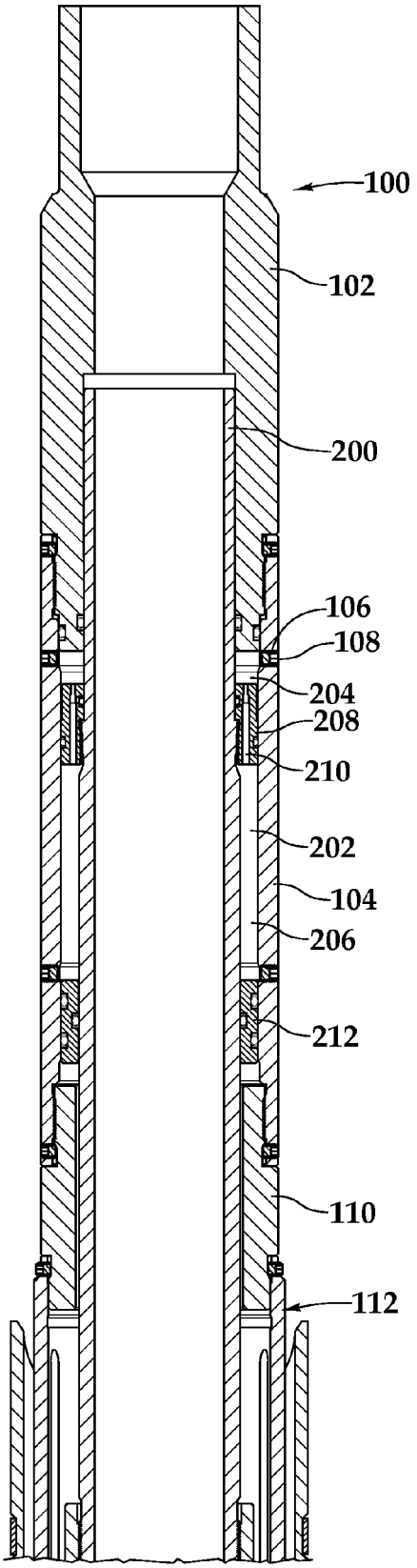
FIGS. 5A-5D are cross sectional views of consecutive axial sections of an apparatus for controlling the connection speed of downhole connectors in an anchored configuration according to an embodiment of the present invention.
Figure 4B:
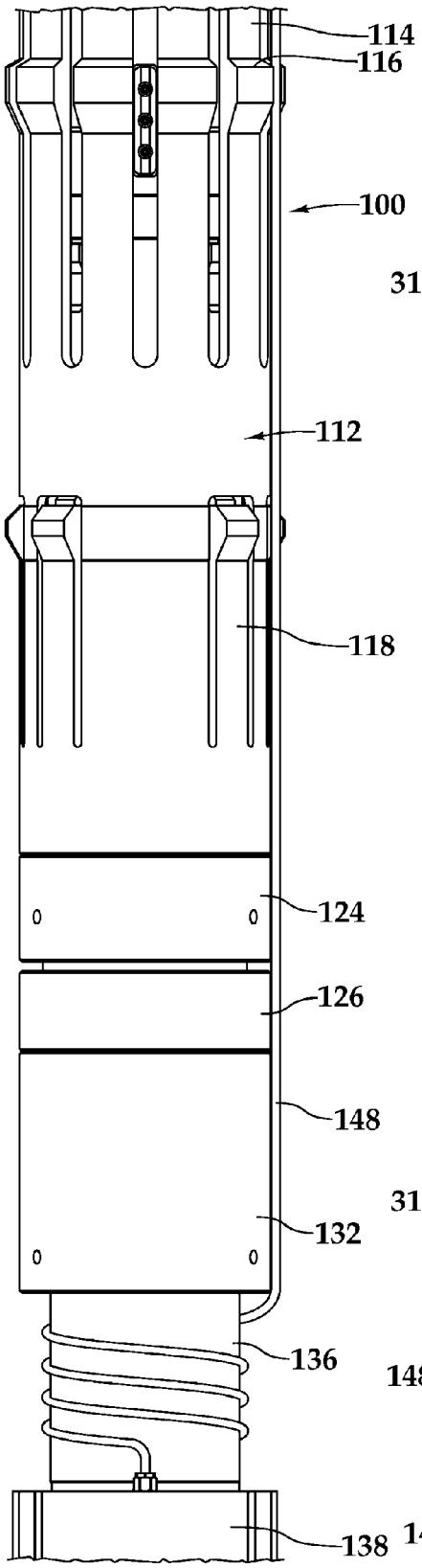
Figure 5B:
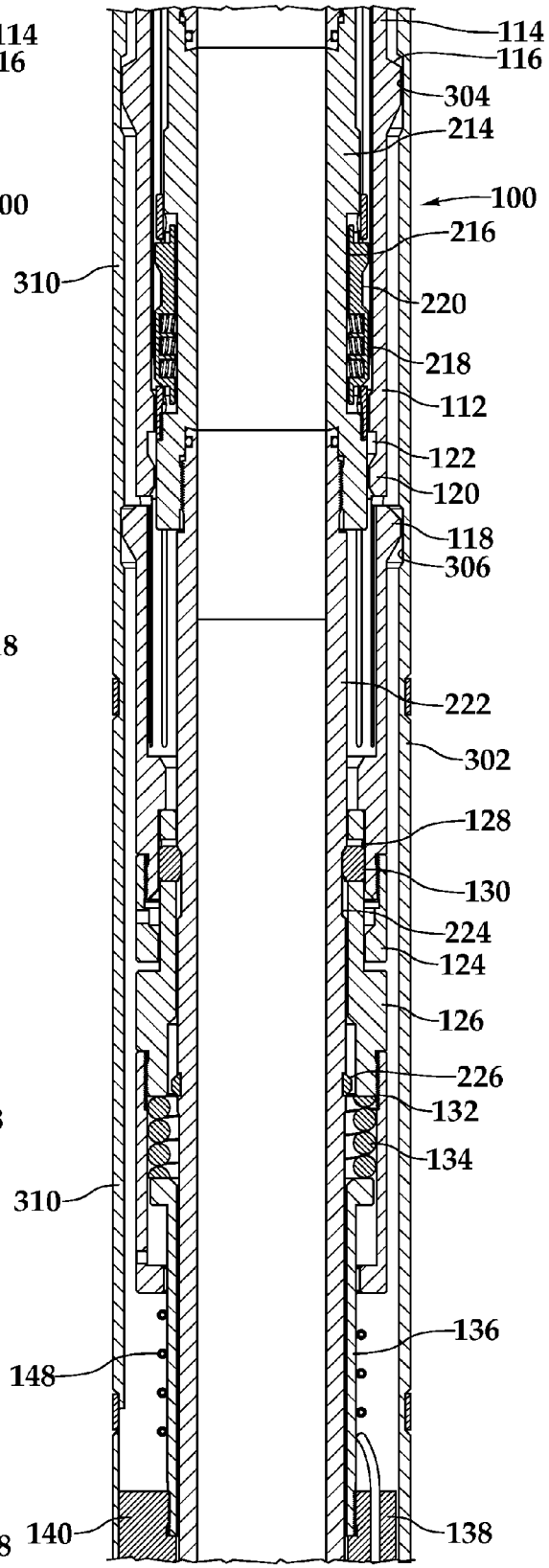
Figure 4C:
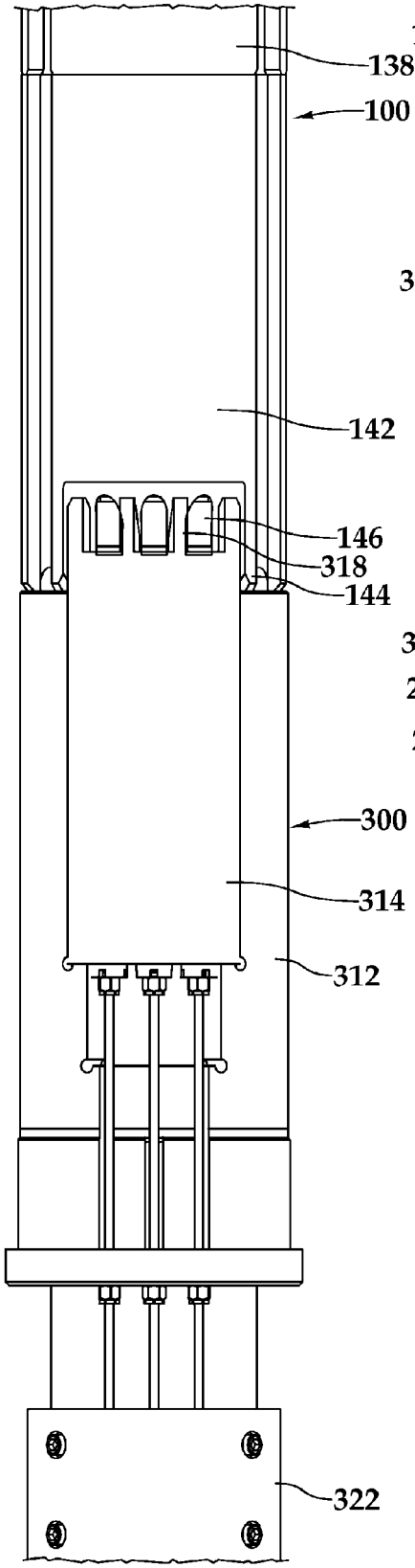
Figure 5C:
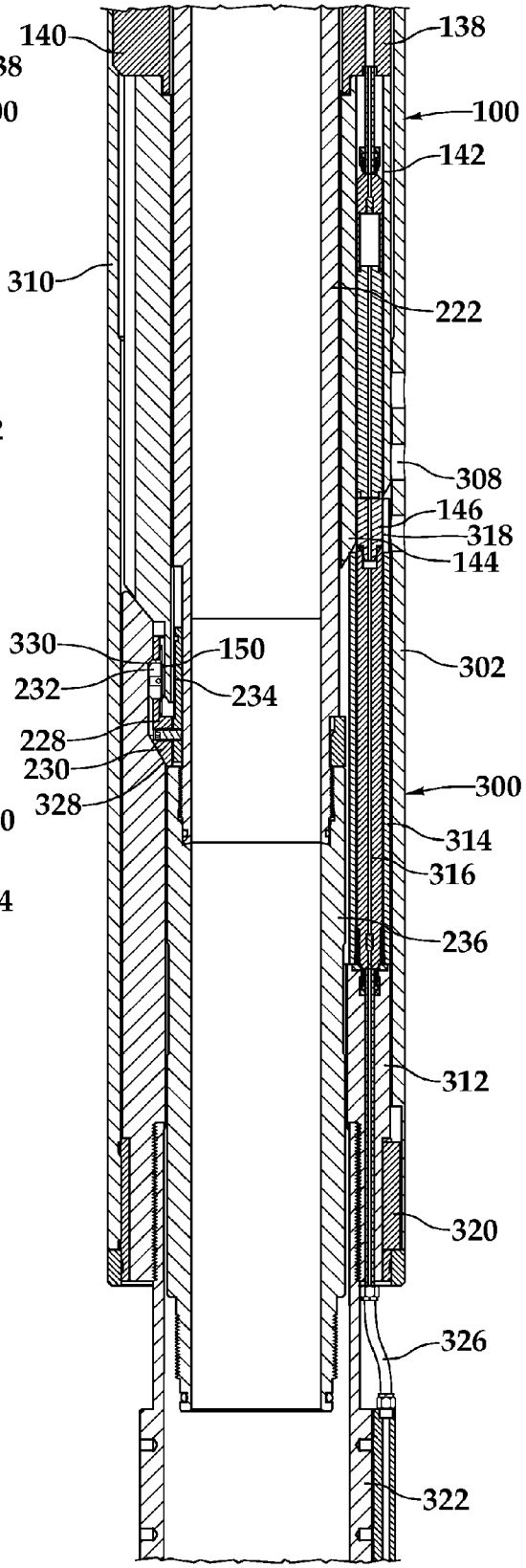
Figure 4D:
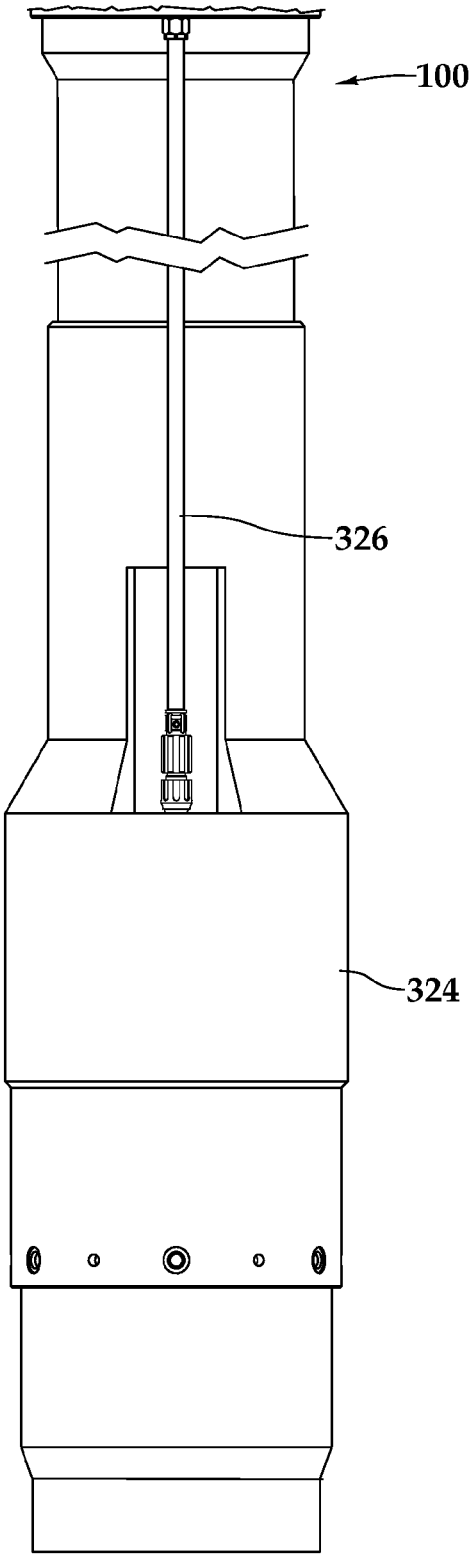
Figure 5D:
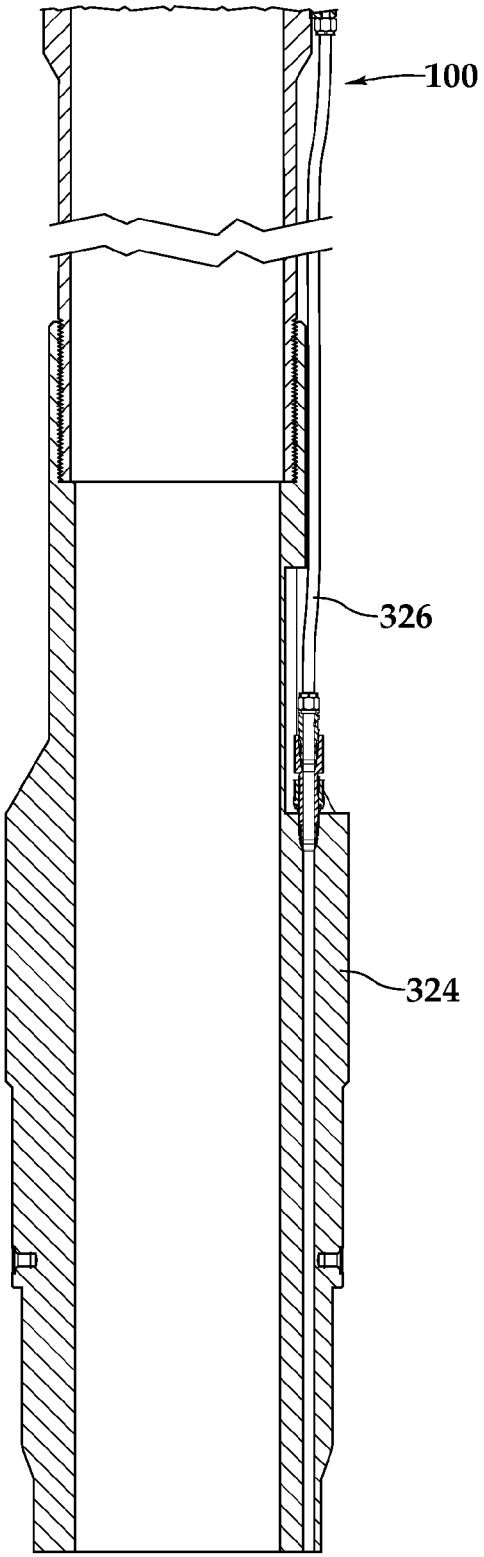
Figure 6A:
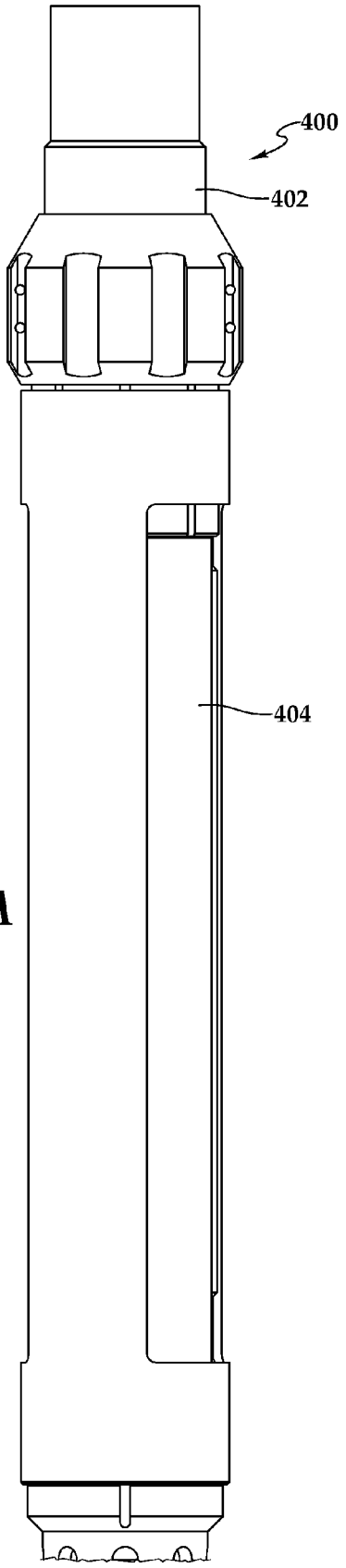
FIGS. 6A-6C and 7A-7C are front views turned 90 degrees relative to one another of consecutive axial sections of an apparatus for controlling the connection speed of downhole connectors according to an embodiment of the present invention.

Referring initially to FIG. 1, an apparatus for controlling the connection speed of downhole connectors deployed from an offshore oil or gas platform is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending production tubing 36.

A wellbore 38 extends through the various earth strata including formation 14. An upper portion of wellbore 38 includes casing 40 that is cemented within wellbore 38. Disposed in an open hole portion of wellbore 38 is a completion 42 that includes various tools such as packer 44, a seal bore assembly 46 and sand control screen assemblies 48, 50, 52, 54. In the illustrated embodiment, completion 42 also includes an orientation and alignment subassembly 56 that houses a downhole wet mate connector. Extending downhole from orientation and alignment subassembly 56 is a conduit 58 that passes through packer 44 and is operably associated with sand control screen assemblies 48, 50, 52, 54. Preferably, conduit 58 is a spoolable metal conduit, such as a stainless steel conduit that may be attached to the exterior of pipe strings as they are deployed in the well. In the illustrated embodiment, conduit 58 is wrapped around sand control screen assemblies 48, 50, 52, 54. One or more communication media such as optical fibers, electrical conducts, hydraulic fluid or the like may be disposed within conduit 58. In certain embodiments, the communication media may operate as energy conductors that are operable to transmit power and/or data between downhole components such as downhole sensors (not pictured) and the surface. In other embodiments, the communication media may operate as downhole sensors.

For example, when optical fibers are used as the communication media, the optical fibers may be used to obtain distributed measurements representing a parameter along the entire length of the fiber such as distributed temperature sensing. In this embodiment, a pulse of laser light from the surface is sent along the fiber and portions of the light are backscattered to the surface due to the optical properties of the fiber. The slightly shifted frequency of the backscattered light provides information that is used to determine the temperature at the point in the fiber where the backscatter originated. In addition, as the speed of light is constant, the distance from the surface to the point where the backscatter originated can also be determined. In this manner, continuous monitoring of the backscattered light will provide temperature profile information for the entire length of the fiber.

Disposed in wellbore 38 at the lower end of production tubing string 36 are a variety of tools including seal assembly 60 and anchor assembly 62 including downhole wet mate connector 64. Extending uphole of connector 64 is a conduit 66 that extends to the surface in the annulus between production tubing string 36 and wellbore 38 and is suitable coupled to production tubing string 36 to prevent damage to conduit 66 during installation. Similar to conduit 58, conduit 66 may have one or more communication media, such as optical fibers, electrical conducts, hydraulic fluid or the like disposed therein. Preferable, conduit 58 and conduit 66 will have the same type of communication media disposed therein such that energy may be transmitted therebetween following the connection process. As discussed in greater detail below, prior to producing fluids, such as hydrocarbon fluids, from formation 14, production tubing string 36 and completion 42 are connected together. When properly connected to each other, a sealed communication path is created between seal assembly 60 and seal bore assembly 46 which establishes a sealed internal flow passage from completion 42 to production tubing string 36, thereby providing a fluid conduit to the surface for production fluids. In addition, as discussed in greater detail below, the present invention enables the communication media associated with conduit 66 to be operatively connected to the communication media associated with conduit 58, thereby enabling communication therebetween and, in the case of optical fiber communication media, enabling distributed temperature information to be obtained along completion 42 during the subsequent production operations.

Even though FIG. 1 depicts a slanted wellbore, it should be understood by those skilled in the art that the apparatus for controlling the connection speed of downhole connectors according to the present invention is equally well suited for use in wellbore having other orientations including vertical wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be understood by those skilled in the art that the apparatus for controlling the connection speed of downhole connectors according to the present invention is equally well suited for use in onshore operations. Further, even though FIG. 1 depicts an open hole completion, it should be understood by those skilled in the art that the apparatus for controlling the connection speed of downhole connectors according to the present invention is equally well suited for use in cased hole completions.

Referring now to FIGS. 2 and 3, including FIGS. 2A-2D and FIGS. 3A-3D, therein is depicted successive axial section of an apparatus for controlling the connection speed of downhole connectors that is generally designated 100. It is noted that FIGS. 2A-2D and FIGS. 3A-3D as well as FIGS. 4A-4D and 5A-5D below are described with reference to optical fibers as the communication media. As discussed above, those skilled in the art will recognize that the present invention is not limited to this illustrated embodiment but instead encompasses other communication media including, but not limited to, electrical conductors and hydraulic fluid. Also, as described above, apparatus 100 is formed from certain components that are initially installed downhole as part of completion 42 and certain components that are carried on the lower end of production tubing string 36. As illustrated in FIG. 2, some the components carried on the lower end of production tubing string 36 have come in contact with certain components of completion 42 prior to connecting the respective wet mate connectors together. The entire apparatus 100 will now be described from its uphole end to its downhole end, first describing the exterior parts of the components carried on the lower end of production tubing string 36, followed by the interior parts of the components carried on the lower end of production tubing string 36 then describing the components previously installed downhole as part of completion 42.

Apparatus 100 includes a substantially tubular axially extending upper connector 102 that is operable to be coupled to the lower end of production tubing string 36 by threading or other suitable means. At its lower end, upper connector 102 is threadedly and sealingly connected to the upper end of a substantially tubular axially extending hone bore 104. Hone bore 104 includes a plurality of lateral opening 106 having plugs 108 disposed therein. At its lower end, hone bore 104 is securably connected to the upper end of a substantially tubular axially extending connector member 110. At its lower end, connector member 110 is securably connected to the upper end of an axially extending collet assembly 112. Collet assembly 112 includes a plurality of circumferentially disposed anchor collets 114, each having an upper surface 116. In addition, collet assembly 112 includes a plurality of circumferentially disposed unlocking collets 118. Further, collet assembly 112 includes a plurality of radially inwardly extending protrusions 120 and profiles 122. At its lower end, collet assembly 112 is threadedly coupled to the upper end of a substantially tubular axially extending key retainer 124. A portion of collet assembly 112 and key retainer 124 are both slidably disposed about the upper end of a substantially tubular axially extending key mandrel 126. Key mandrel 126 includes a key window 128 into which a spring key 130 is received.

At its lower end, key mandrel 126 is threadedly coupled to the upper end of a substantially tubular axially extending spring housing 132. Disposed within spring housing 132 is an axially extending spiral wound compression spring 134. At its lower end, spring housing 132 is slidably disposed about the upper end of a substantially tubular axially extending connector member 136. At its lower end, connector member 136 is threadedly coupled to the upper end of a substantially tubular axially extending splitter 138. Splitter 138 includes an orientation key 140 disposed about a circumferential portion of splitter 138. At its lower end, splitter 138 is coupled to the upper end of a substantially tubular axially extending fiber optic wet mate head 142 by threading, bolting or other suitable technique. Fiber optic wet mate head 142 includes a plurality of guide members 144. In the illustrated embodiment, fiber optic wet mate head 142 has three fiber optic wet mate connectors 146 disposed therein. Each of the fiber optic wet mate connectors 146 has an optical fiber disposed therein. As illustrated, the three optical fibers associated with fiber optic wet mate connectors 146 passed through splitter 138 and are housed within a single conduit 148 that wraps around connector member 136 and extends uphole along the exterior of apparatus 100. Conduit 148 is secured to apparatus 100 by banding or other suitable technique.

In the previous section, the exterior components of the portion of apparatus 100 carried by production tubing string 36 were described. In this section, the interior components of the portion of apparatus 100 carried by production tubing string 36 will be described. At its upper end, apparatus 100 includes a substantially tubular axially extending piston mandrel 200 that is slidably and sealingly received within upper connector 102. Disposed between piston mandrel 200 and hone bore 104 is an annular oil chamber 202 including upper section 204 and lower section 206. Securably attached to piston mandrel 200 and sealing positioned within annular oil chamber 202 is a transfer piston 208. Transfer piston 208 includes one or more passageways 210 therethrough which preferably include orifices that regulate the rate at which a transfer fluid such as a liquid or gas and preferably an oil disposed within annular oil chamber 202 may travel therethrough. Preferably, a check valve may be disposed within each passageway 210 to allow the flow of oil to proceed in only one direction through that passageway 210. In this embodiment, certain of the check valves will allow fluid flow in the uphole direction while other of the check valves will allow fluid flow in the downhole direction. In this manner, the resistance to flow in the downhole direction can be different from the resistance to flow in the uphole direction which respectively determines the speed of coupling and decoupling of the downhole connectors of apparatus 100. For example, it may be desirable to couple the downhole connectors at a speed that is slower than the speed at which the downhole connectors are decoupled.

Disposed within annular oil chamber 202 is a compensation piston 212 that has a sealing relationship with both the inner surface of hone bore 104 and the outer surface of piston mandrel 200. At its lower end, piston mandrel 200 is threadedly and sealingly coupled to the upper end of a substantially tubular axially extending key block 214. Key block 214 has a radially reduced profile 216 into which spring mounted locking keys 218 are positioned. Locking keys 218 include a profile 220. At its lower end, key block 214 is threadedly and sealingly coupled to the upper end of a substantially tubular axially extending bottom mandrel 222. Bottom mandrel 222 includes a groove 224. A pickup ring 226 is positioned around bottom mandrel 222. Positioned near the lower end of bottom mandrel 222 is a key carrier 228 that has a no go surface 230. Disposed within key carrier 228 is a spring mounted locking key 232. Positioned between key carrier 228 and bottom mandrel 222 is a torque key 234. At its lower end, bottom mandrel 222 is threadedly and sealingly coupled to the upper end of a substantially tubular axially extending seal adaptor 236. At its lower end, seal adaptor 236 is threadedly and sealingly coupled to the upper end of one or more substantially tubular axially extending seal assemblies (not pictured) that establish a sealing relationship with an interior surface of completion 42.

In the previous two sections, the components of apparatus 100 carried by production tubing string 36 were described. Collectively, these components may be referred to as an anchor or anchoring assembly. In this section, the components of apparatus 100 installed with completion 42 will be described. Apparatus 100 includes an orientation and alignment subassembly 300 that includes a locating and orienting guide 302 that is illustrated in FIG. 3 but has been removed from FIG. 2 for clarity of illustration. Locating and orienting guide 302 includes a locking profile 304, a groove 306 and a plurality of fluid passageways 308. In addition, locating and orienting guide 302 includes a receiving slot 310. Disposed within locating and orienting guide 302, orientation and alignment subassembly 300 includes a top subassembly 312 that supports a fiber optic wet mate holder 314. In the illustrated embodiment, disposed within wet mate holder 314 are three wet mate connectors 316. At its upper end, wet mate holder 314 includes a plurality of guides 318. Positioned between top subassembly 312 and locating and orienting guide 302 is a key 320. At its lower end, top subassembly 312 is threadedly and sealingly coupled to the upper end of a substantially tubular axially extending splitter 322. At its lower end, splitter 322 is coupled to the upper end of one or more substantially tubular axially extending packers 324 by threading, bolting, fastening or other suitable technique. Each of the fiber optic wet mate connectors 316 has an optical fiber disposed therein. As illustrated, the three optical fibers associated with fiber optic wet mate holder 314 pass through splitter 322 and are housed within a single conduit 326 that extends through packer 324 and is wrapped around sand control screens 48, 50, 52, 54 as described above to obtain distributed temperature information, for example.

The operation of the apparatus for controlling the connection speed of downhole connectors according to the present invention will now be described. After the installation of completion 42 in the wellbore and the performance of any associated treatment processes wherein the optical fibers associated with completion 42 and companion optical fibers associated with the service tool string may deliver information to the surface, the service tool string is retrieved to the surface. In this process, the optical fibers associated with completion 42 and the optical fibers associated with the service tool string must be decoupled. In order to reuse the optical fibers associated with completion 42 during production, new optical fibers must be carried with production tubing string 36 and optically coupled to the optical fibers associated with completion 42.

In the present invention, conduit 148 is attached to the exterior of production tubing string 36 and extends from the surface to the anchor assembly. One or more optical fibers are disposed within conduit 148 which may be a conventional hydraulic line formed from stainless steel or similar material. The anchor assembly is lowered into the wellbore until the seal assemblies on its lower end enter completion 42. As production tubing string 36 is further lowered into the wellbore, orientation key 140 contacts the inclined surfaces of locating and orientating guide 302. This interaction rotates the anchor assembly until orientation key 140 locates within slot 310 which provides a relatively coarse circumferential alignment of fiber optic wet mate head 142 with fiber optic wet mate holder 314. The anchor assembly now continues to travel downwardly in completion 42 until no go surface 230 of key carrier 228 contacts an upwardly facing shoulder 328 of top subassembly 312. Prior to contact between no go surface 230 and upwardly facing shoulder 328, guides 144 of fiber optic wet mate head 142 and guides 318 of fiber optic wet mate holder 314 interact to provide more precise circumferential and axially alignment of the assemblies.

Once no go surface 230 contacts upwardly facing shoulder 328, further downward motion of the inner components of the anchor assembly stops. In this configuration, as best seen in FIGS. 2A-2D and 3A-3D, unlocking collets 118 are radially inwardly shifted due to contact with the inner surface of locating and orienting guide 302. This radially inward shifting causes the inner surfaces of unlocking collets 118 to contact unlocking keys 218 and compress the associated springs causing unlocking keys 218 to radially inwardly retract. In the retraced position, radially inwardly extending protrusions 120 are released from profile 220, thereby decoupling the outer portions of the anchor assembly from the inner portions of the anchor assembly. Relative axially movement of the outer portions of the anchor assembly and the inner portions of the anchor assembly is now permitted.

As continued downward force is placed on the anchor assembly by applying force to the production tubing string 36, upper connector 102 is urged downwardly relative to piston mandrel 200. The movement of upper connector 102 relative to piston mandrel 200 is resisted, however, by a resistance member. In the illustrated embodiment, the resistance member is depicted as transfer piston 208 and the fluid within annular oil chamber 202. Specifically, the speed at which upper connector 102 can move relative to piston mandrel 200 is determined by the size of the orifice within passageway 210 of transfer piston 208 as well as the type of fluid, including liquids, gases or combinations thereof, within annular oil chamber 202. As the downward force is applied to upper connector 102, the fluid from upper section 204 of annular oil chamber 202 transfers to lower section 206 of annular oil chamber 202 passing through passageway 210. In this manner, excessive connection speed of fiber optic wet mate connectors 146 and fiber optic wet mate connectors 316 is prevented. Even though the resistance member has been described as transfer piston 208 and the fluid within annular oil chamber 202, it should be understood by those skilled in the art that other types of resistance members could alternatively be used and are considered within the scope of the present invention, including, but not limited to, mechanical springs, fluid springs, fluid dampeners, shock absorbers and the like.

As best seen in FIGS. 4A-4D and 5A-5D, continued downward force on upper connector 102 not only enables connection of fiber optic wet mate connectors 146 and fiber optic wet mate connectors 316, but also, compresses the outer components of the anchor assembly and locks the anchor assembly within completion 42. Once the connection between fiber optic wet mate connectors 146 and fiber optic wet mate connectors 316 is established, thereby permitting light transmission between the optical fibers therein, continued downward force on upper connector 102 compresses spring 134. As spring 134 is compressed, spring housing 132 telescopes relative to connector member 136. This shortening of the outer components of the anchor assembly allows spring key 130 to engage groove 224 of bottom mandrel 222. Once spring key 130 has radially inwardly retracted, the outer components of the anchor assembly further collapse as collet assembly 112 and key retainer 124 telescope relative to key mandrel 126. This shortening allows anchor collets 114 to engage locking profile 304 which couples the anchor assembly within completion 42. Also, this shortening allows unlocking collets 118 to engage groove 306 which relaxes unlocking collets 118. In addition, the inner portions of the anchor assembly are independently secured within completion 42 as extension 150 on the lower end of fiber optic wet mate head 142 is positioned under locking key 232 such that locking key 232 engages profile 330 of top subassembly 312.

In this configuration, not only are fiber optic wet mate connectors 146 and fiber optic wet mate connectors 316 coupled together, there is a biasing force created by compressed spring 134 that assures the connections will not be lost. Specifically, compressed spring 134 downwardly biases connector member 136 which in turn applies a downward force on splitter 138 and fiber optic wet mate head 142. This force prevents any decoupling of fiber optic wet mate connectors 146 and fiber optic wet mate connectors 316. In addition, the interaction of surface 116 of anchor collets 114 with locking profile 304 of locating and orienting guide 302 prevents separation of the anchoring assembly and the completion 42. If it is desired to detach production tubing string 36 from completion 42, a significant tensile force must be applied to production tubing string 36 at the surface, for example, 20,000 lbs. This force is transmitted via upper connector 102, hone bore 104 and connector member 110 to collet assembly 112. When sufficient tensile force is provided, anchor collets 114 will release from locking profile 304. Thereafter, the outer portions of anchor assembly that were telescopically contracted can be telescopically extended including the release of energy from spring 134. In order to separate fiber optic wet mate connectors 146 and fiber optic wet mate connectors 316, the outer portions of the anchor assembly must be shifted relative to the inner portions of the anchor assembly. The rate of the axial shifting is again controlled by the metering rate of fluid through transfer piston 212. After the outer portions of the anchor assembly have been shifted relative to the inner portions of the anchor assembly, extension 150 no longer supports locking key 232 in profile 330. As this point the entire anchor assembly may be retrieved to the surface.

Figure 7A:
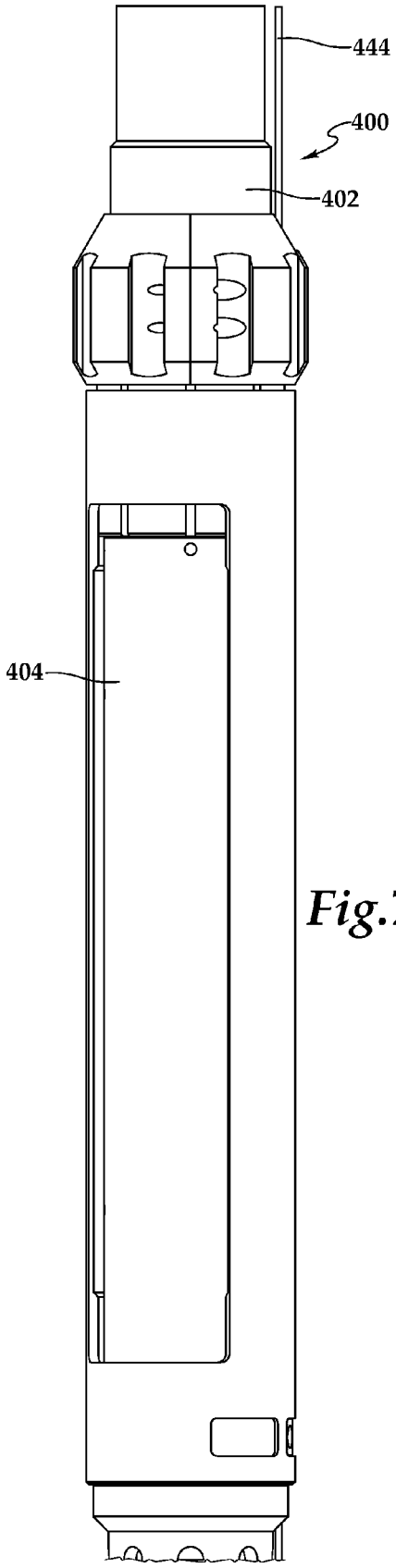
Figure 6B:
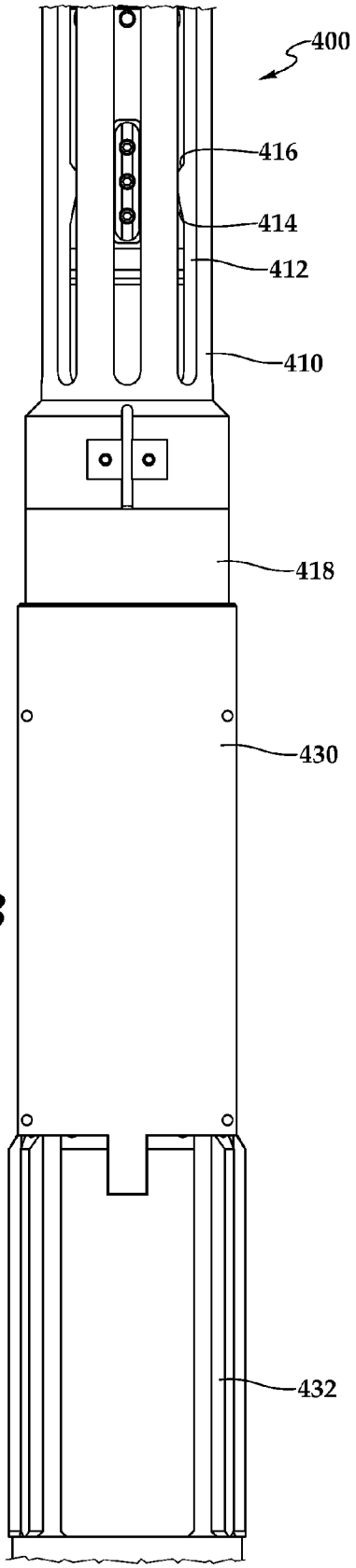
Figure 7B:
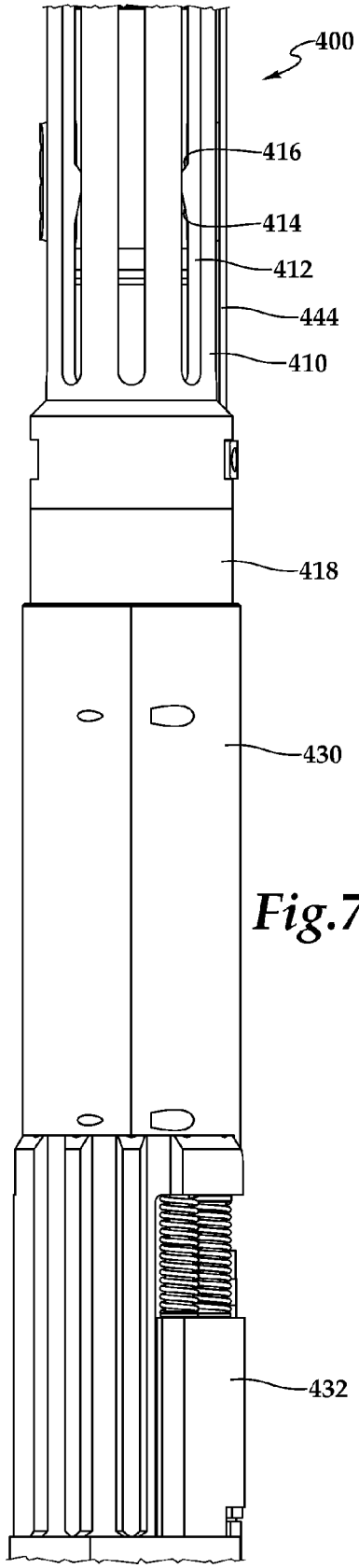
Figure 6C:
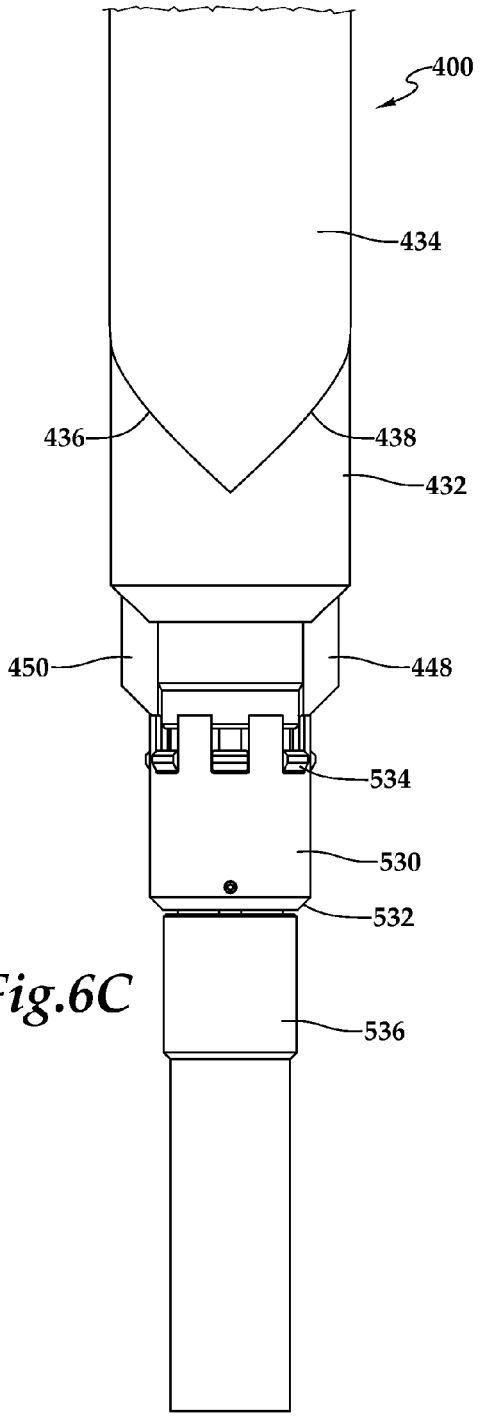
Figure 7C:
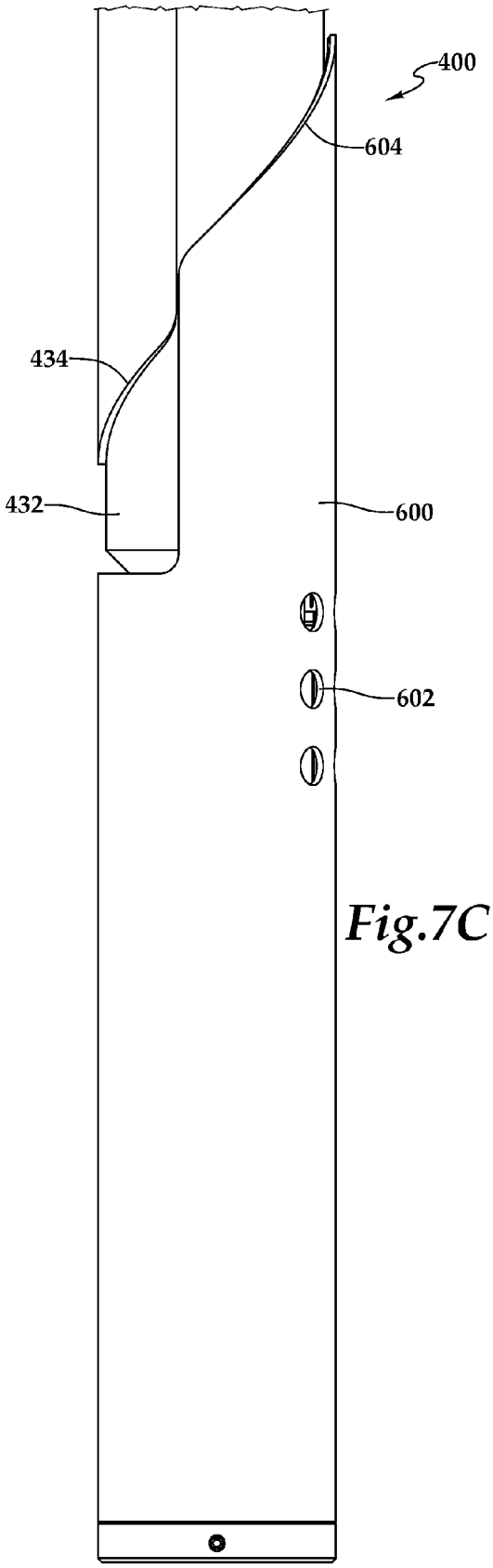
Figure 8A:
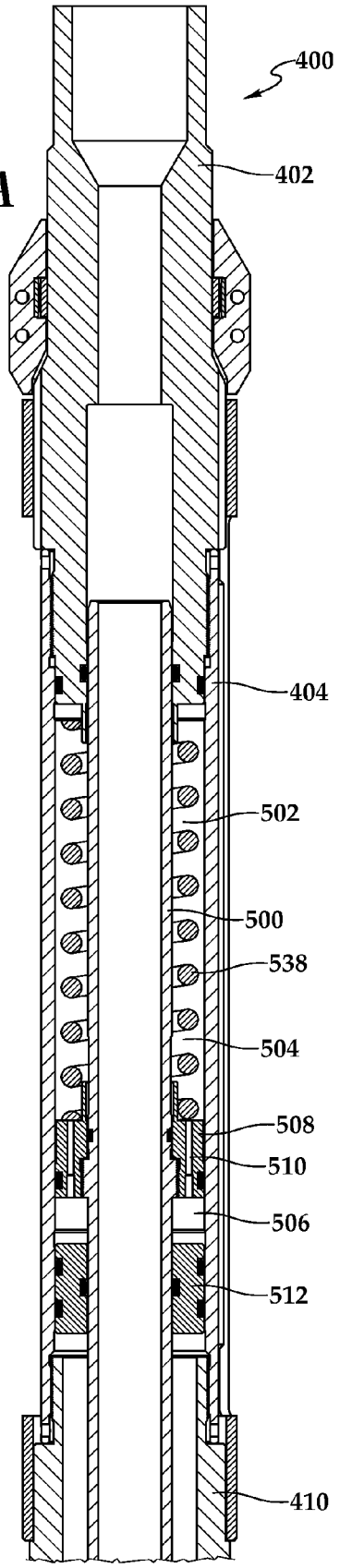
FIGS. 8A-8C and 9A-9C are cross sectional views turned 90 degrees relative to one another of consecutive axial sections of an apparatus for controlling the connection speed of downhole connectors in a running configuration according to an embodiment of the present invention.
Figure 9A:
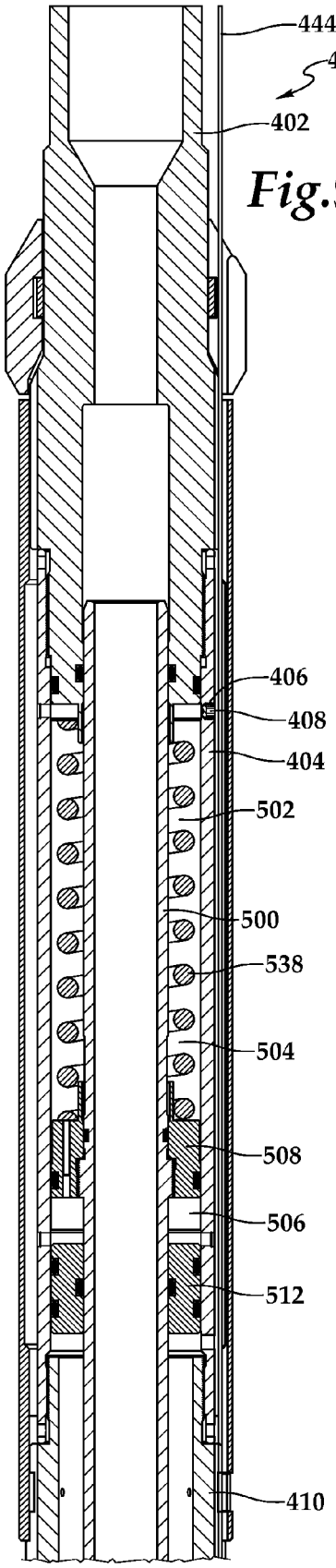
Figure 8B:
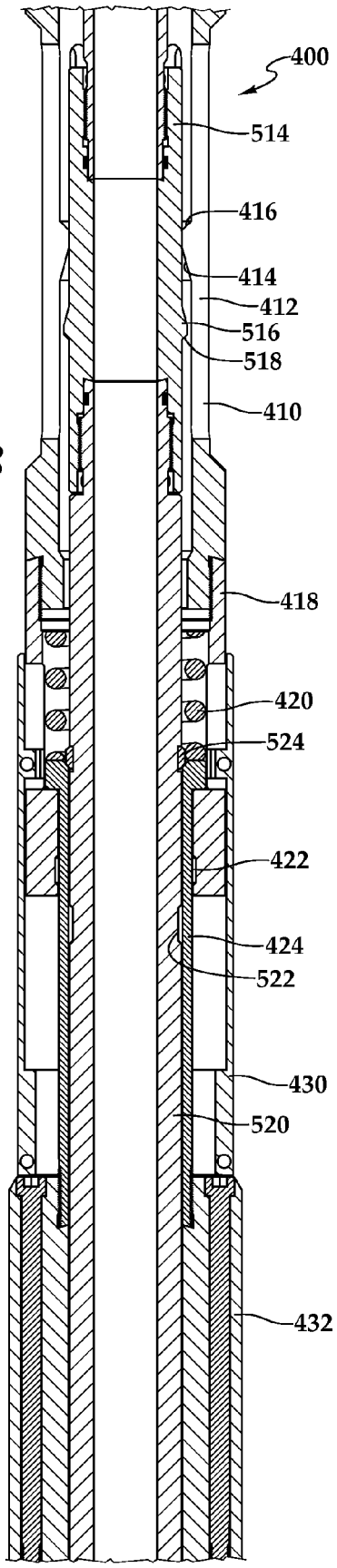
Figure 9B:
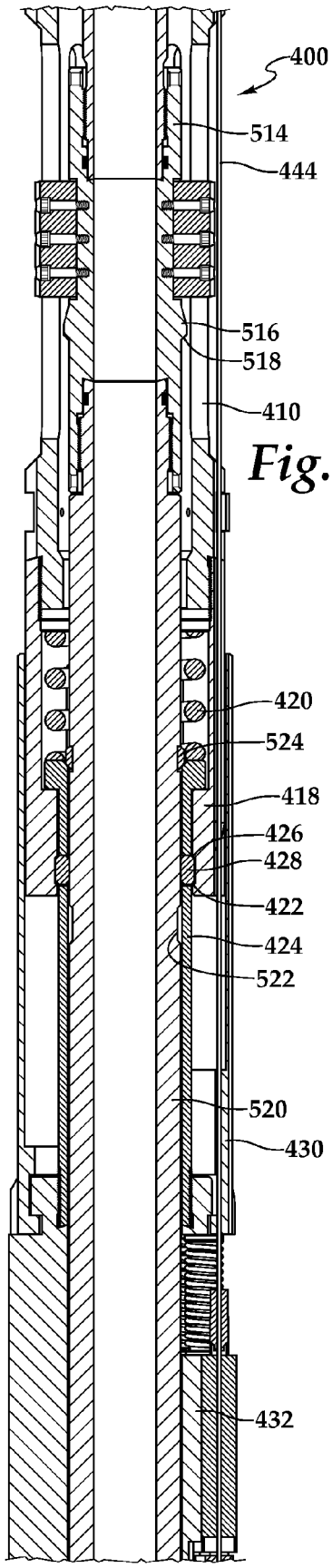
Figure 8C:
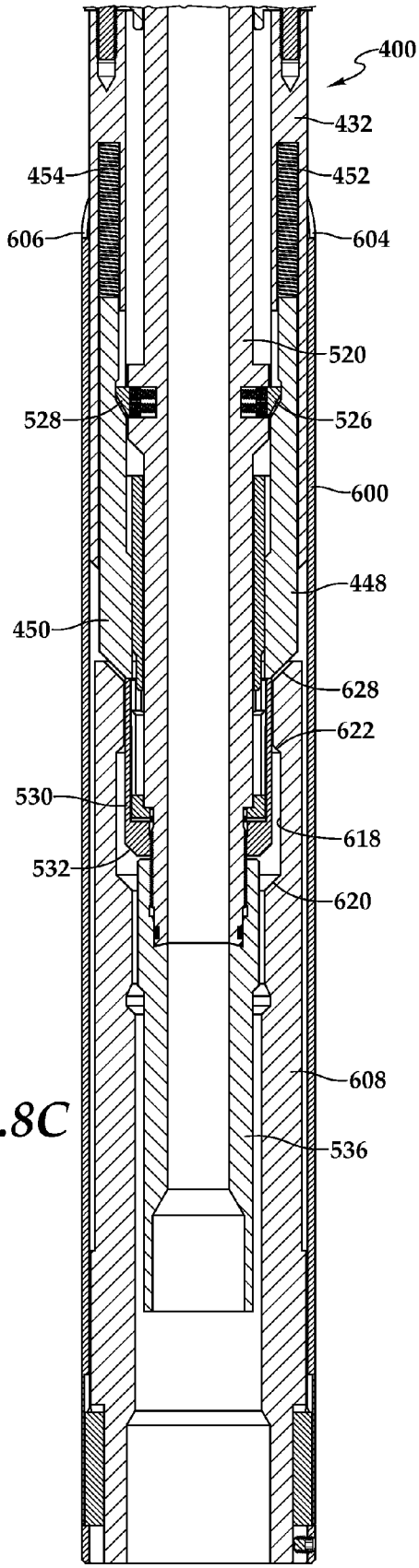
Figure 9C:
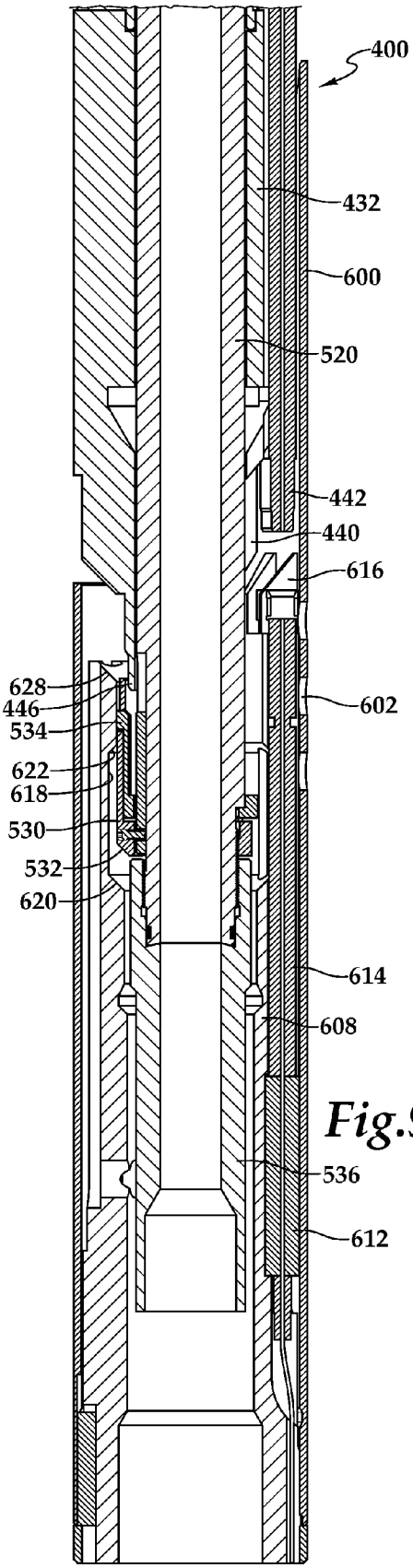
Figure 10A:
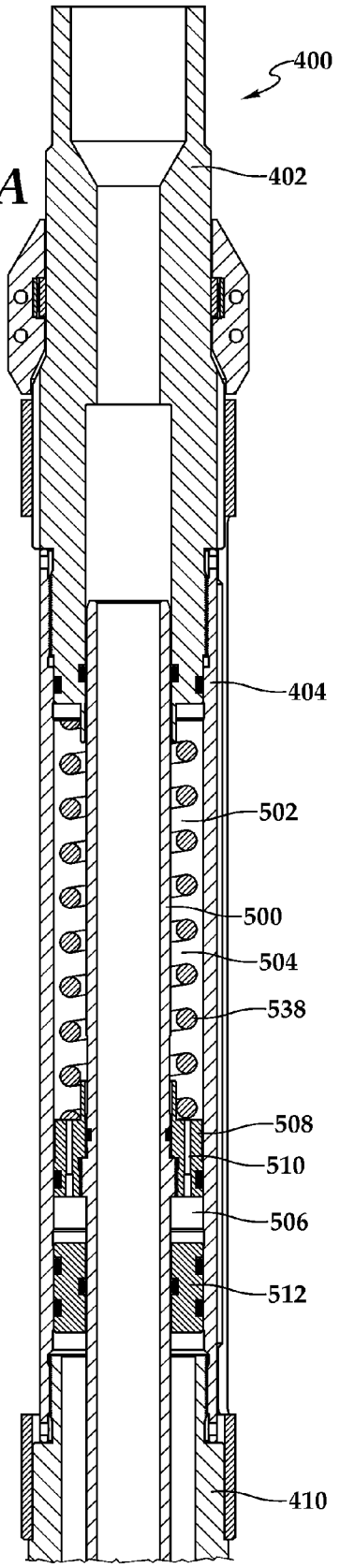
FIGS. 10A-10C and 11A-11C are cross sectional views turned 90 degrees relative to one another of consecutive axial sections of an apparatus for controlling the connection speed of downhole connectors in an unlocked configuration according to an embodiment of the present invention.
Figure 11A:
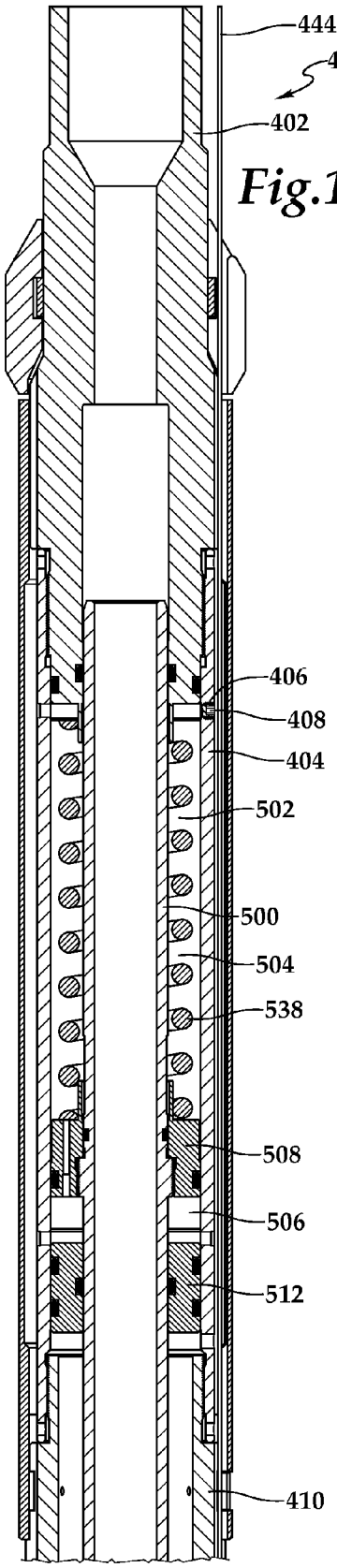
Figure 10B:
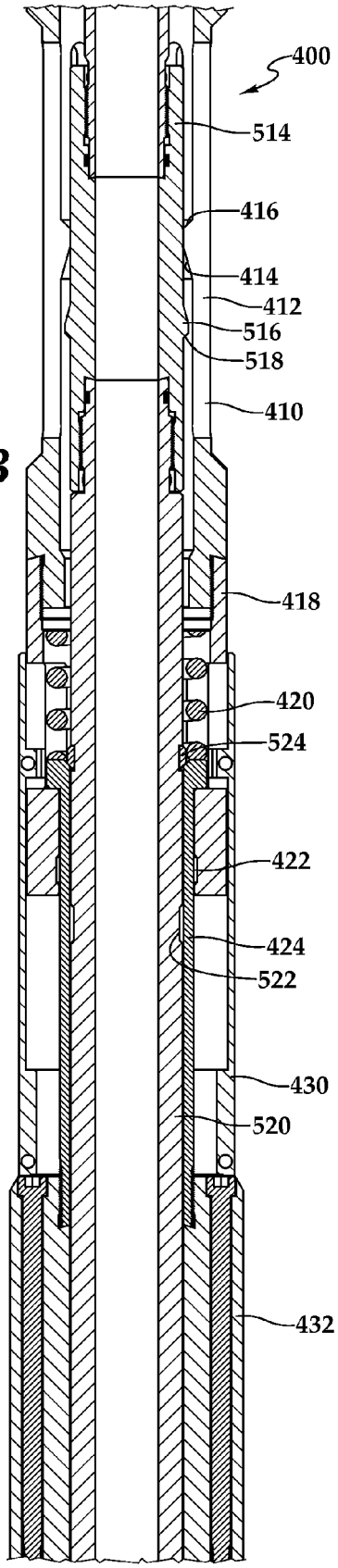
Figure 11B:
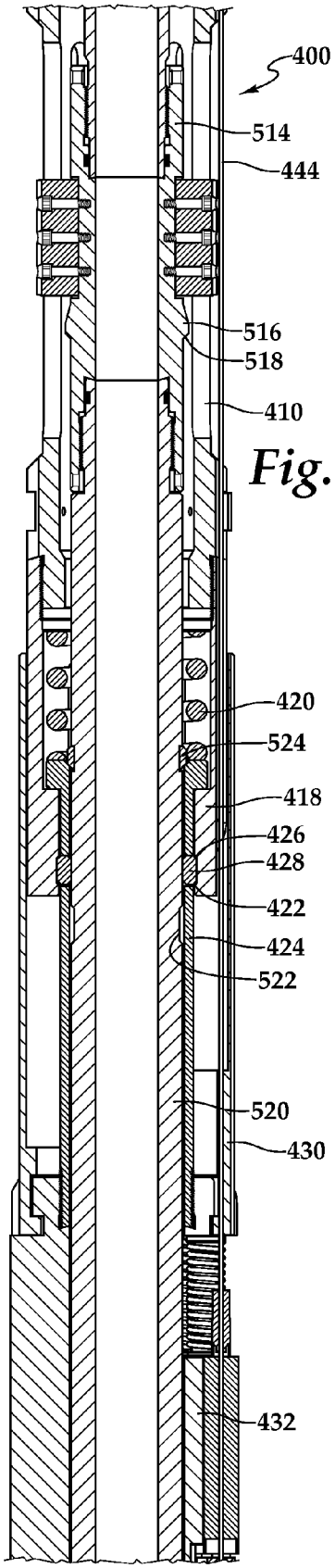
Figure 10C:
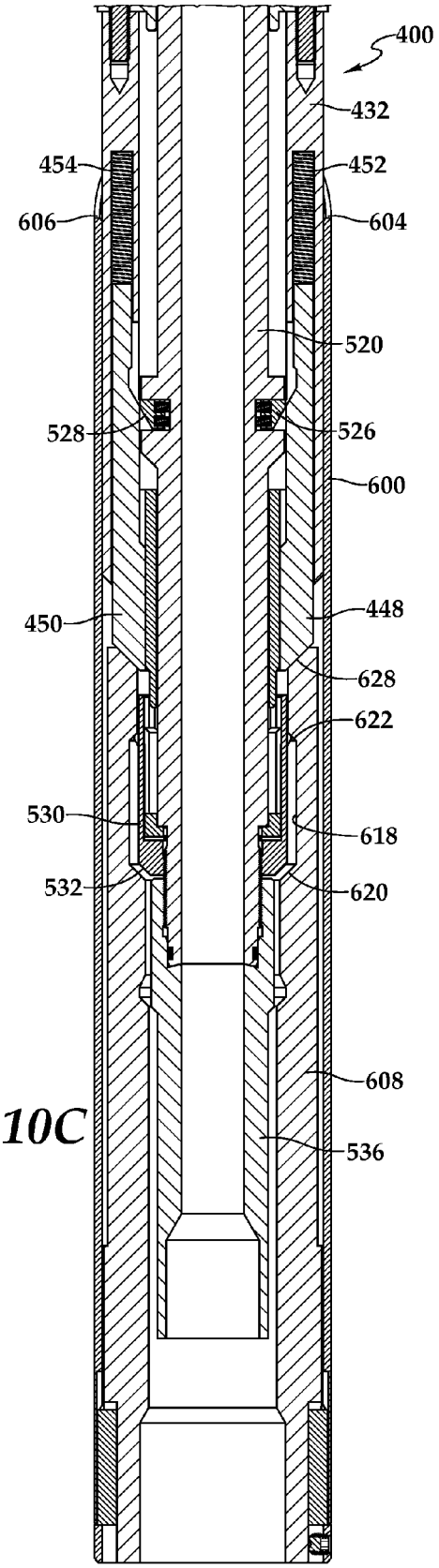
Figure 11C:
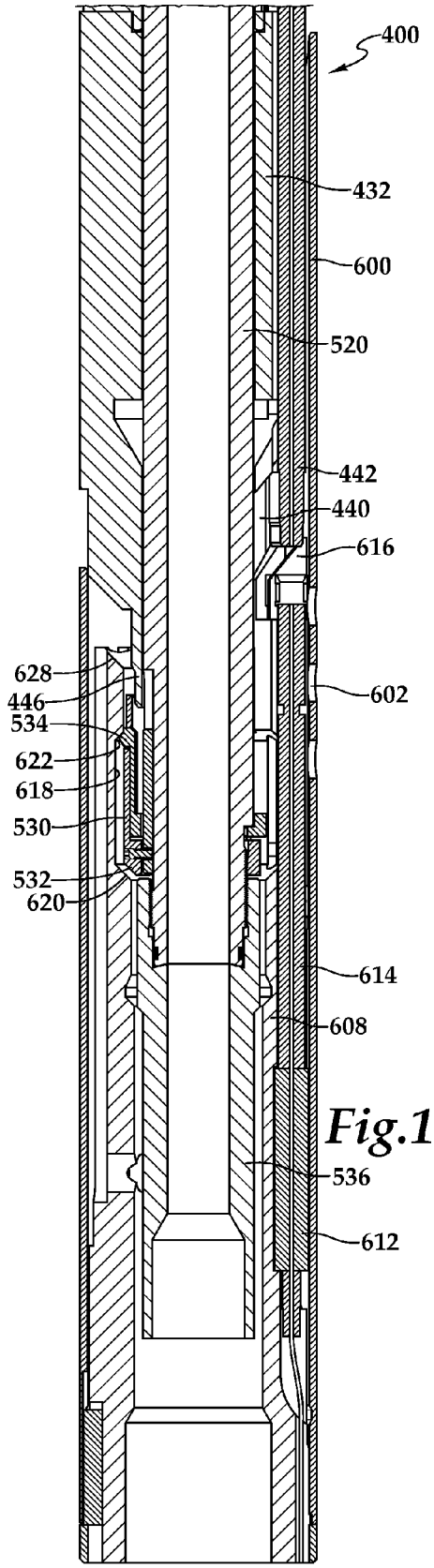
Figure 12A:
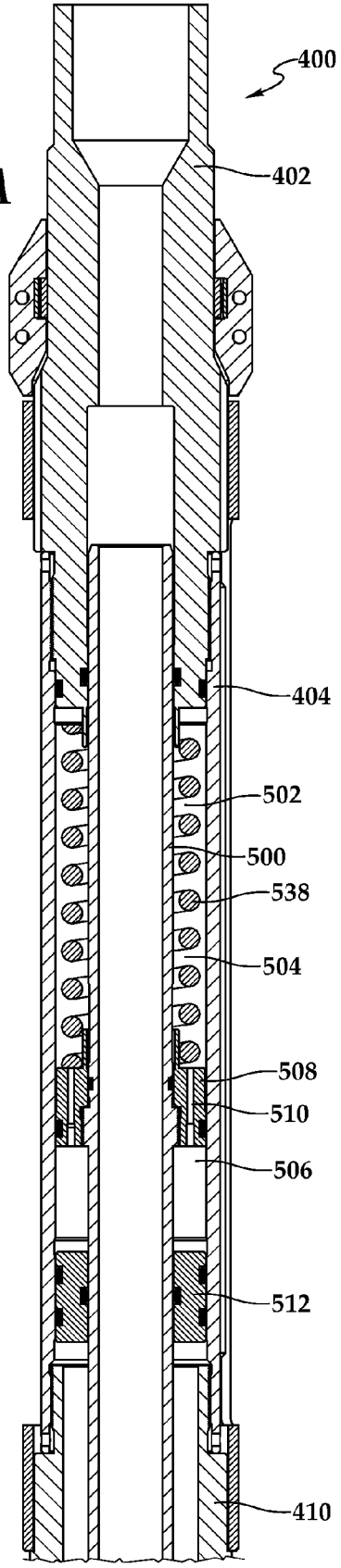
FIGS. 12A-12C and 13A-13C are cross sectional views turned 90 degrees relative to one another of consecutive axial sections of an apparatus for controlling the connection speed of downhole connectors in a connected configuration according to an embodiment of the present invention.
Figure 13A:
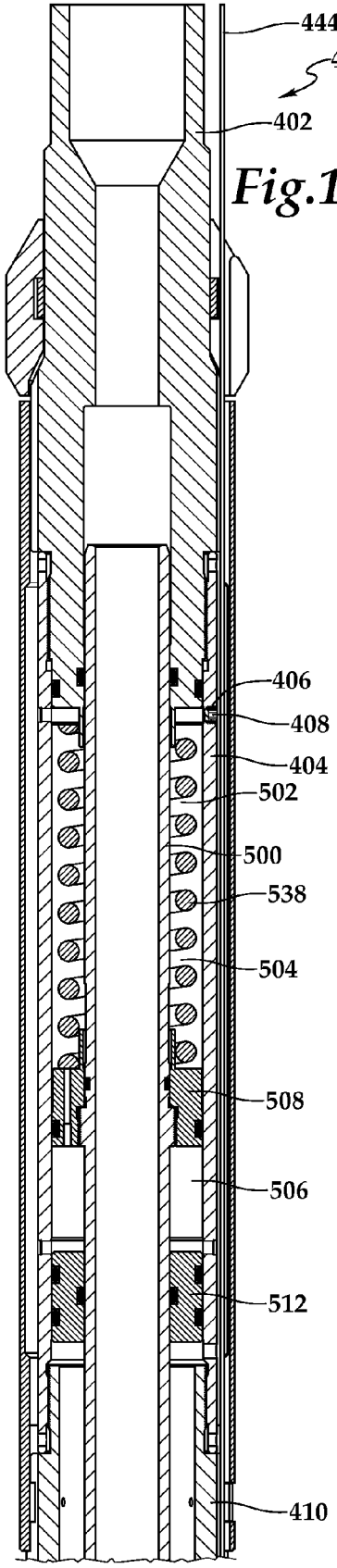
Figure 12B:
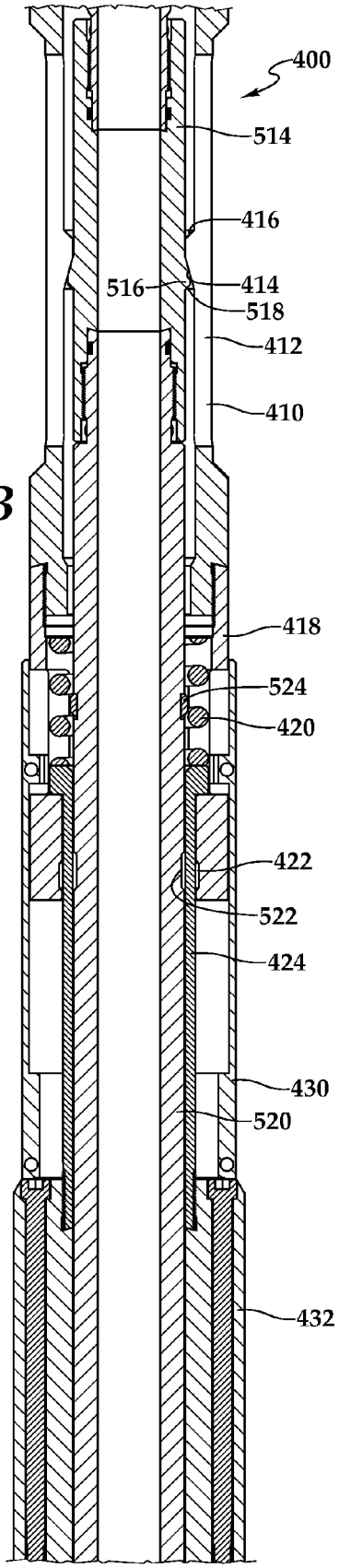
Figure 13B:
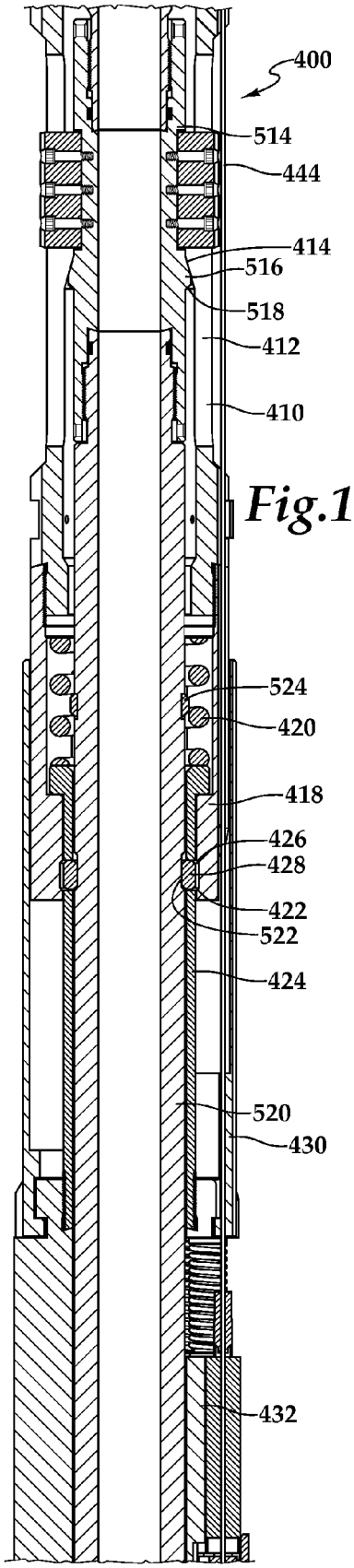
Figure 12C:
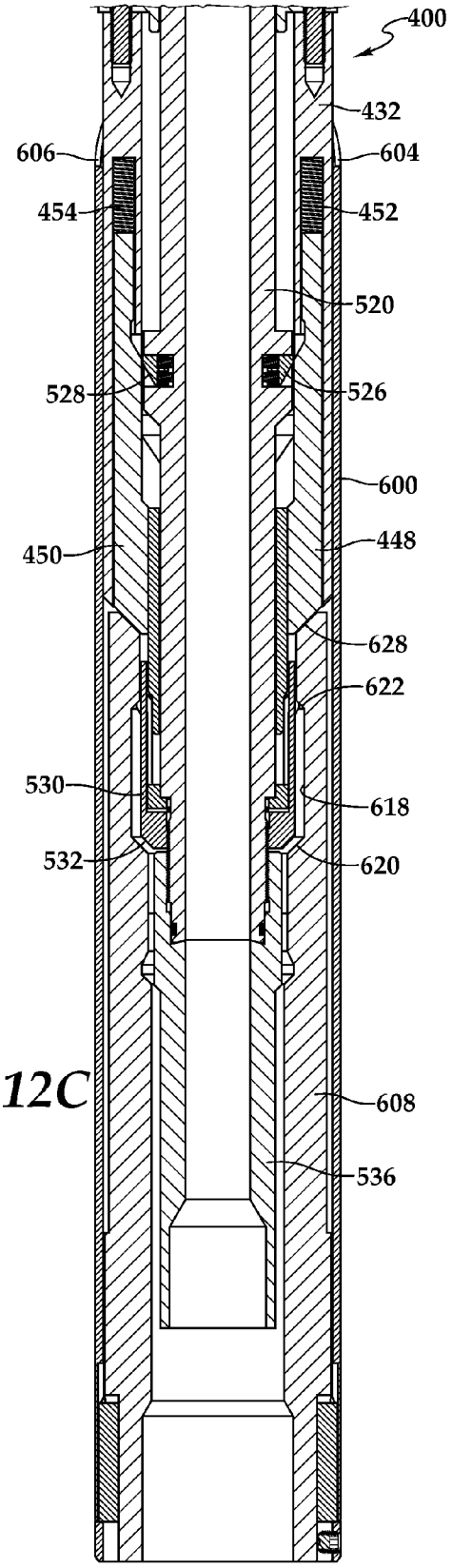
Figure 13C:
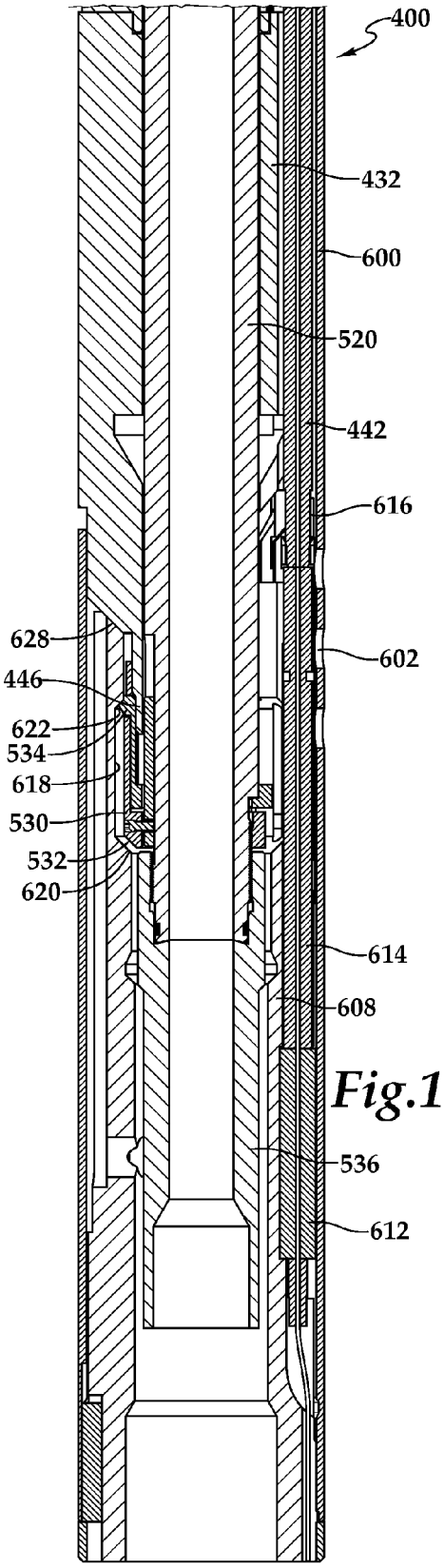
Figure 14A:
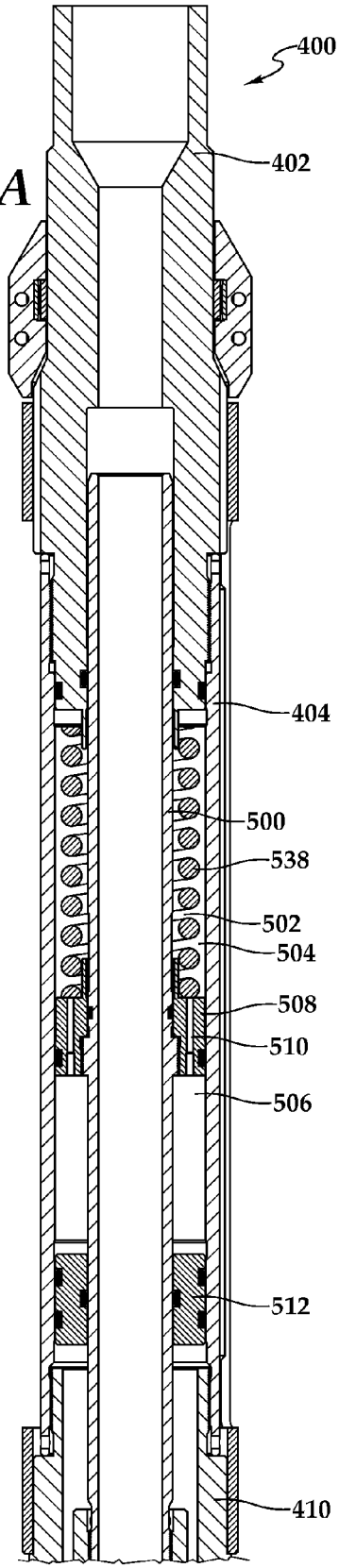
FIGS. 14A-14C and 15A-15C are cross sectional views turned 90 degrees relative to one another of consecutive axial sections of an apparatus for controlling the connection speed of downhole connectors in a fully compressed configuration according to an embodiment of the present invention.
Figure 15A:
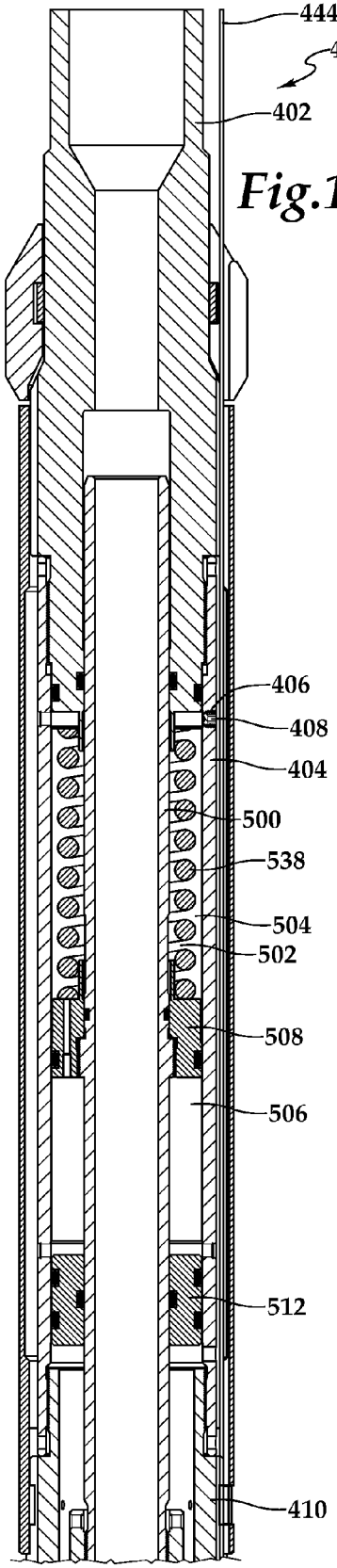
Figure 14B:
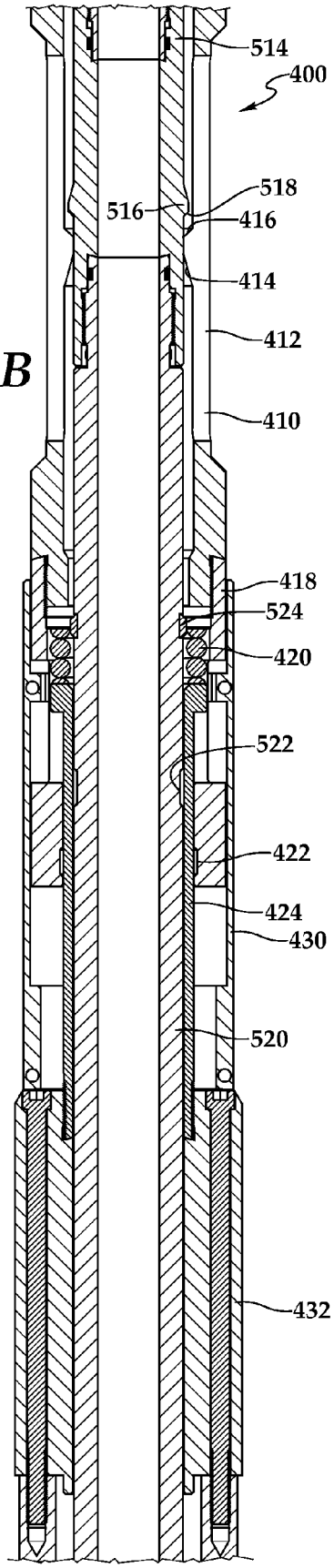
Figure 15B:
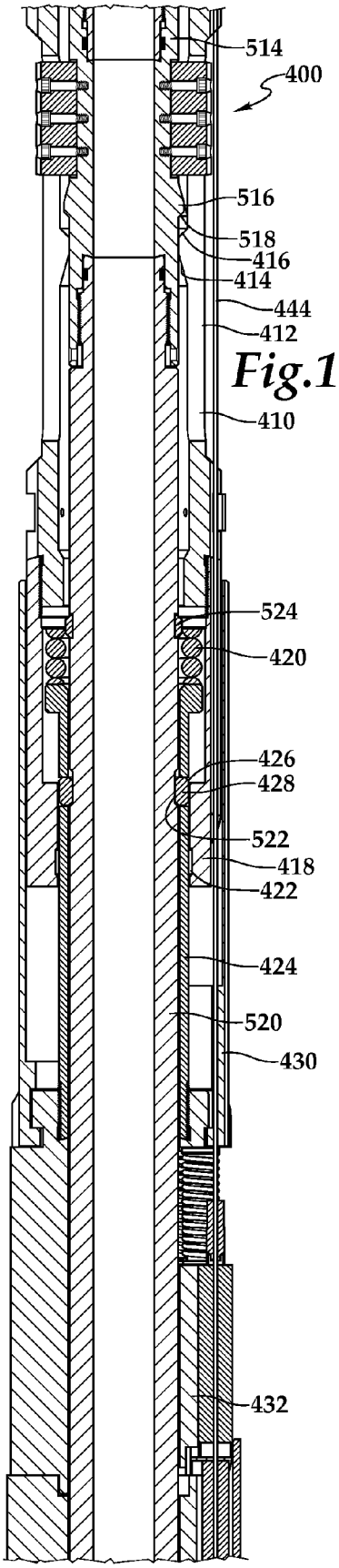
Figure 14C:
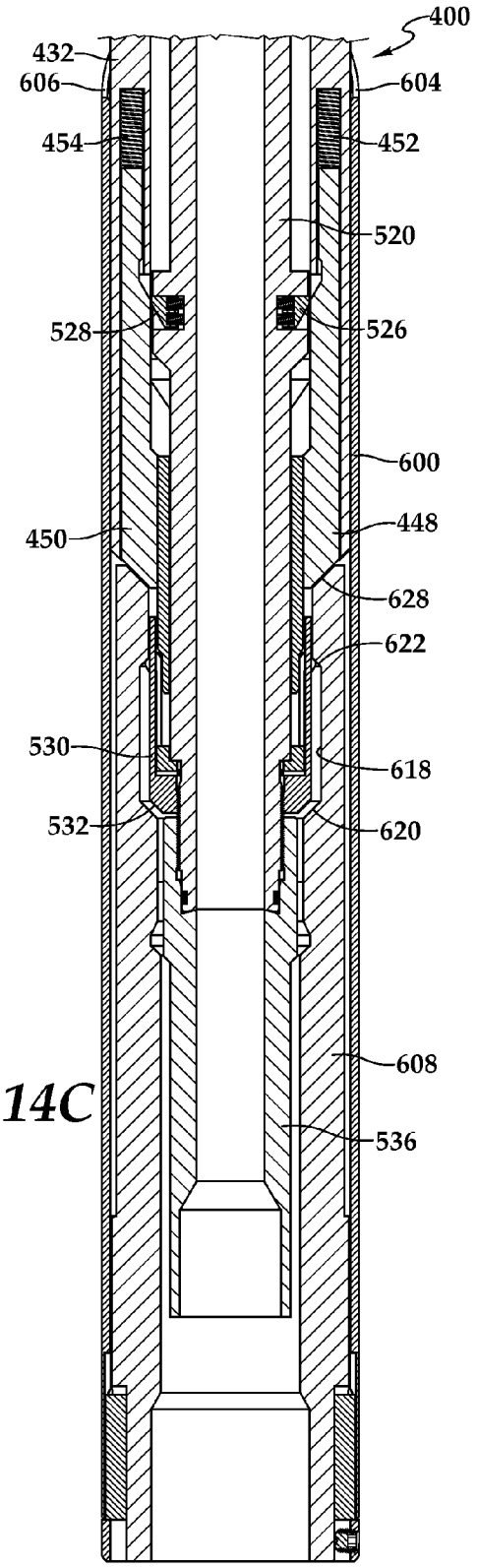
Figure 15C:
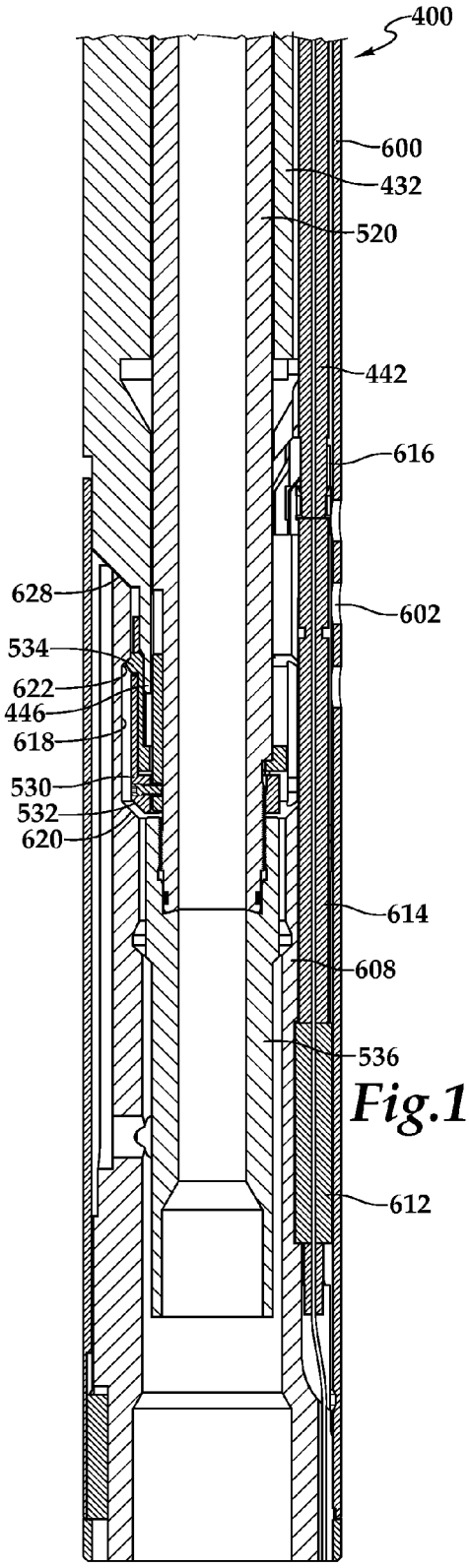
Figure 16A:
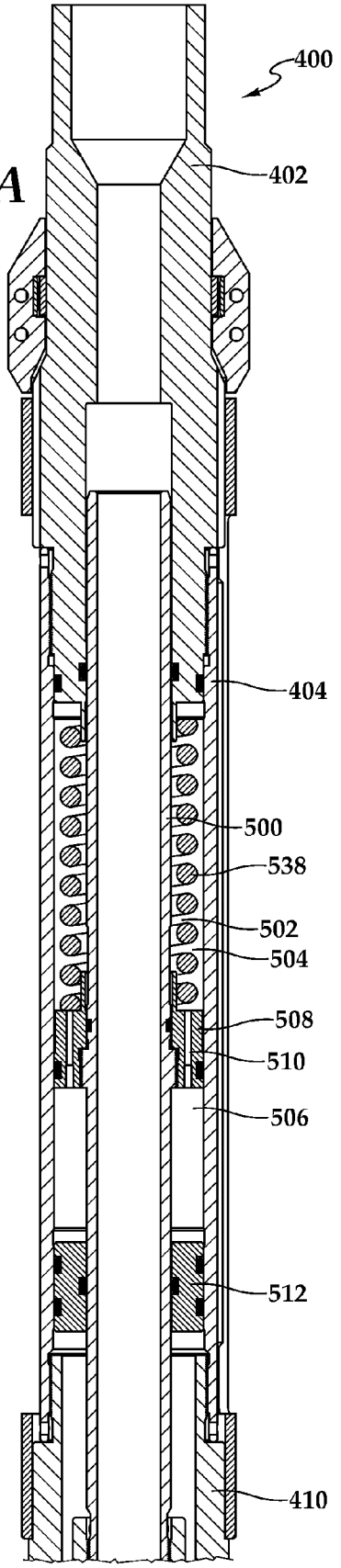
FIGS. 16A-16C and 17A-17C are cross sectional views turned 90 degrees relative to one another of consecutive axial sections of an apparatus for controlling the connection speed of downhole connectors in a locked configuration according to an embodiment of the present invention.
Figure 17A:
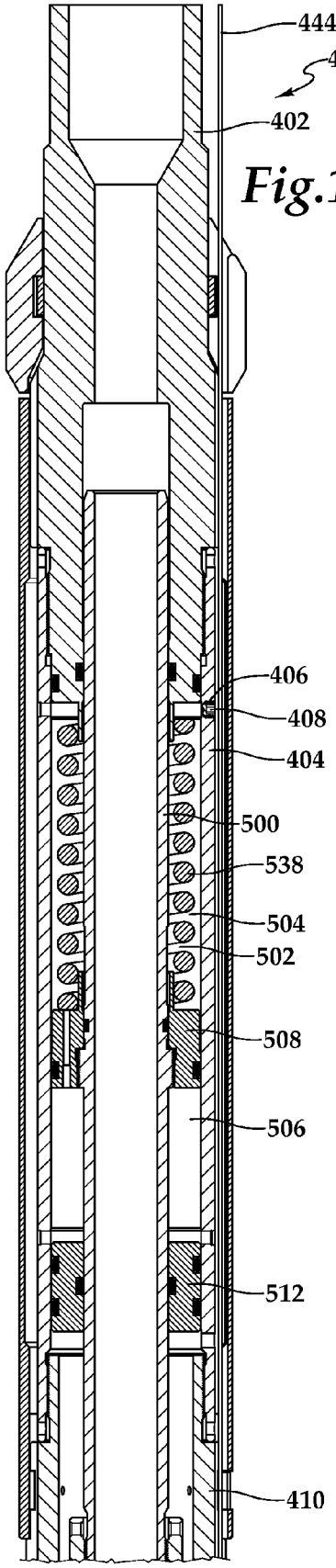
Figure 16B:
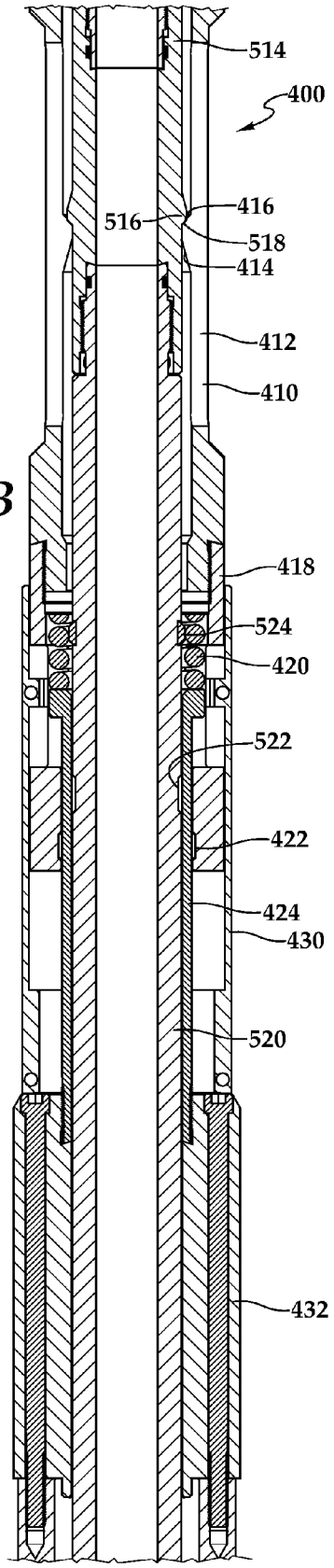
Figure 17B:
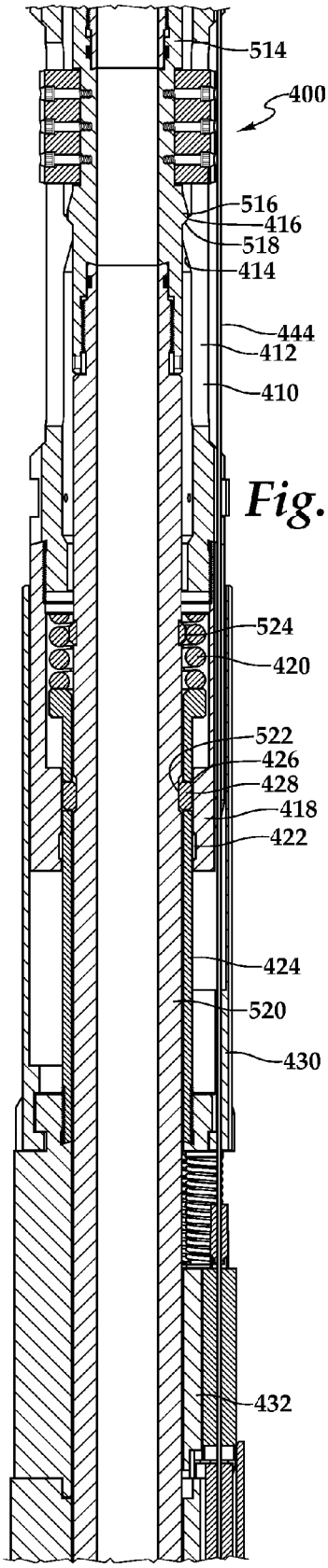
Figure 16C:
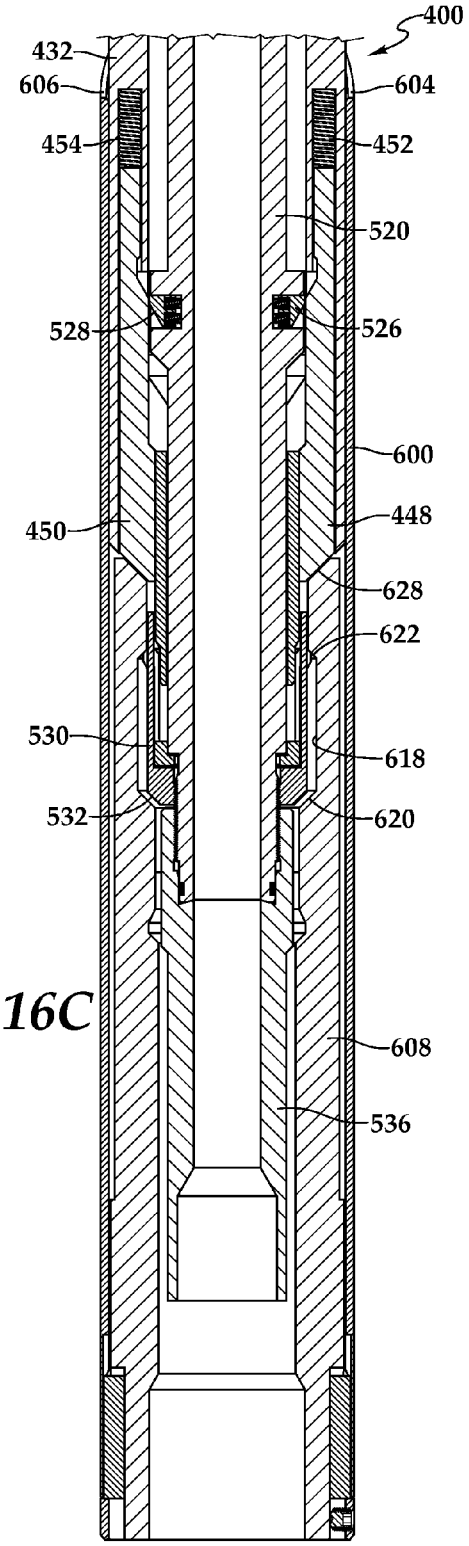
Figure 17C:
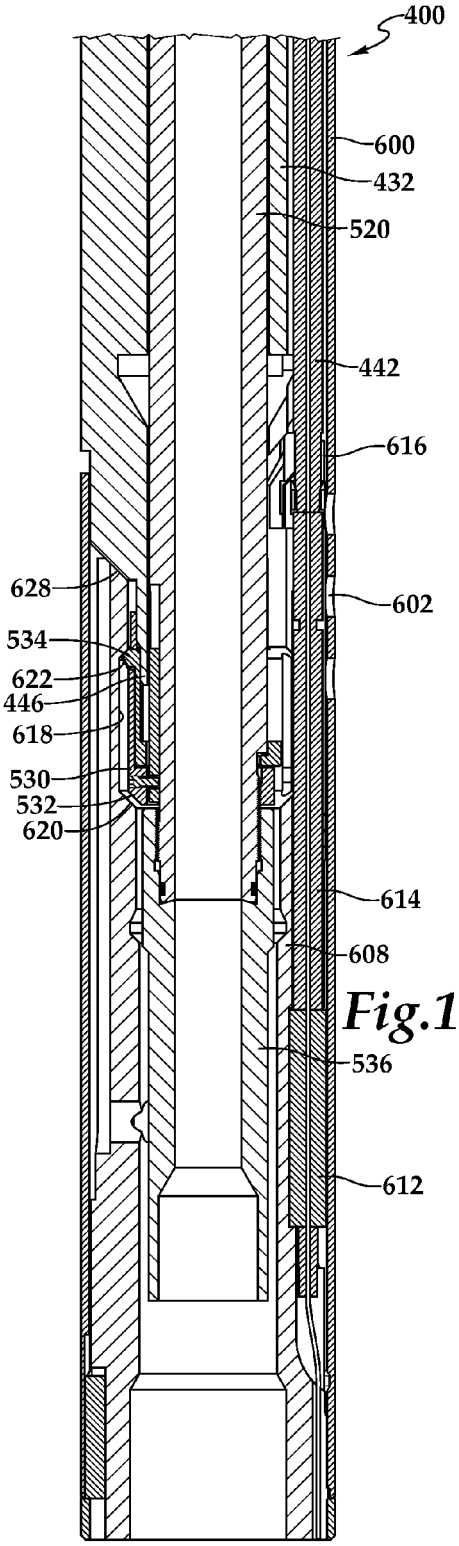

Referring now to FIGS. 6-9, including FIGS. 6A-6C, 7A-7C, 8A-8C and 9A-9C, therein is depicted successive axial section of an apparatus for controlling the connection speed of downhole connectors that is generally designated 400. It is noted that FIGS. 6A-6C and 7A-7C are multiple views of the same apparatus turned 90 degrees relative to one another with the downhole part of completion 42 being removed in FIGS. 6A-6C. Likewise, FIGS. 8A-8C and 9A-9C are multiple views of the same apparatus turned 90 degrees relative to one another. As described above, apparatus 400 is formed from certain components that are initially installed downhole as part of completion 42 and certain components that are carried on the lower end of production tubing string 36. As illustrated in FIGS. 7-9, some the components carried on the lower end of production tubing string 36 have come in contact with certain components of completion 42 prior to connecting the respective wet mate connectors together. The entire apparatus 400 will now be described from its uphole end to its downhole end, first describing the exterior parts of the components carried on the lower end of production tubing string 36, followed by the interior parts of the components carried on the lower end of production tubing string 36 then describing the components previously installed downhole as part of completion 42.

Apparatus 400 includes a substantially tubular axially extending upper connector 402 that is operable to be coupled to the lower end of production tubing string 36 by threading or other suitable means. At its lower end, upper connector 402 is threadedly and sealingly connected to the upper end of a substantially tubular axially extending hone bore 404. Hone bore 404 includes a plurality of lateral opening 406 having plugs 408 disposed therein. At its lower end, hone bore 404 is securably connected to the upper end of a substantially tubular axially extending collet assembly 410 that includes a plurality of circumferentially disposed locking collets 412 each having a radially inwardly extending protrusion 414 with an upper surface 416. At its lower end, collet assembly 410 is threadedly coupled to the upper end of a substantially tubular axially extending spring housing 418. Disposed within spring housing 418 is an axially extending spiral wound compression spring 420. Spring housing 418 includes an annular groove 422. At its lower end, spring housing 418 is slidably disposed about the upper end of a substantially tubular axially extending spring support member 424 that include a plurality of windows 426 having keys 428 positioned therein. A debris housing 430 is positioned around spring housing 418 and spring support member 424.

At its lower end, spring support member 424 is threadedly coupled to the upper end of a substantially tubular axially extending fiber optic wet mate head 432. Fiber optic wet mate head 432 includes an orientation guide 434 that preferably has opposing helical surfaces 436, 438. Fiber optic wet mate head 432 includes a plurality of guide members 440. In the illustrated embodiment, fiber optic wet mate head 432 has three fiber optic wet mate connectors 442 disposed therein. Each of the fiber optic wet mate connectors 442 has an optical fiber disposed therein. As illustrated, the three optical fibers associated with fiber optic wet mate connectors 442 may pass through a splitter such that they are housed within a single conduit 444 that extends uphole from apparatus 400 to the surface. Conduit 444 may be secured to apparatus 400 by any suitable means such as banding or similar technique. At its lower end, fiber optic wet mate head 432 includes a prop member 446. Slidably received in a pair of slots in fiber optic wet mate head 432 is a pair of plungers 448, 450 which are individually biased by a pair of springs 452, 454.

In the previous section, the exterior components of the portion of apparatus 400 carried by production tubing string 36 were described. In this section, the interior components of the portion of apparatus 400 carried by production tubing string 36 will be described. At its upper end, apparatus 400 includes a substantially tubular axially extending piston mandrel 500 that is slidably and sealingly received within upper connector 402. Disposed between piston mandrel 500 and hone bore 404 is an annular oil chamber 502 including upper section 504 and lower section 506. Securably attached to piston mandrel 500 and sealing positioned within annular oil chamber 502 is a transfer piston 508. Transfer piston 508 includes one or more passageways 510 therethrough which preferably include orifices that regulate the rate at which a transfer fluid, such as a liquid or gas and preferably an oil disposed within annular oil chamber 502, may travel therethrough. Preferably, a check valve may be disposed within each passageway 510 to allow the flow of oil to proceed in only one direction through that passageway 510. In this embodiment, certain of the check valves will allow fluid flow in the uphole direction while other of the check valves will allow fluid flow in the downhole direction. In this manner, the resistance to flow in the downhole direction can be different from the resistance to flow in the uphole direction which respectively determines the speed of coupling and decoupling of the downhole connectors of apparatus 400. For example, it may be desirable to couple the downhole connectors at a speed that is slower than the speed at which the downhole connectors are decoupled.

Disposed within annular oil chamber 502 is a compensation piston 512 that has a sealing relationship with both the inner surface of hone bore 404 and the outer surface of piston mandrel 500. At its lower end, piston mandrel 500 is threadedly and sealingly coupled to the upper end of a substantially tubular axially extending locking profile assembly 514 that includes a radially outwardly extending annular protrusion 516 having a shoulder 518. Together, locking profile assembly 514 and locking collets 412 may be referred to herein as a lock assembly. At its lower end, locking profile assembly 514 is threadedly and sealingly coupled to the upper end of a substantially tubular axially extending bottom mandrel 520. Bottom mandrel 520 includes a radially inwardly extending groove 522. A pickup ring 524 is positioned around bottom mandrel 520. A pair of spring operated lugs 526, 528 is received within a pair of radially reduces sections of bottom mandrel 520. Together, spring operated lugs 526, 528 and plungers 448, 450 may be referred to herein as a lock assembly. Positioned near the lower end of bottom mandrel 520 is a key assembly 530 that has a locator surface 532 and a plurality of locking keys 534. At its lower end, bottom mandrel 520 is threadedly and sealingly coupled to the upper end of a substantially tubular axially extending seal adaptor 536. At its lower end, seal adaptor 536 is threadedly and sealingly coupled to the upper end of one or more substantially tubular axially extending seal assemblies (not pictured) that establish a sealing relationship with an interior surface of completion 42.

In the previous two sections, the components of apparatus 400 carried by production tubing string 36 were described. Collectively, these components may be referred to as an anchor or anchoring assembly. In this section, the components of apparatus 400 installed with completion 42 will be described. Apparatus 400 includes an orienting guide 600 that has a plurality of fluid passageways 602. In addition, orienting guide 600 preferably has opposing helical surfaces 604, 606. Disposed within orienting guide 600 is a top subassembly 608 that supports a fiber optic wet mate holder 612. In the illustrated embodiment, disposed within wet mate holder 612 are three wet mate connectors 614. At its upper end, wet mate holder 612 includes a plurality of guides 616. Top subassembly 608 has a radially reduced section 618 having a frustoconical surface 620 and a frustoconical surface 622. In addition, at its upper end, top subassembly 608 has a frustoconical surface 628. Each of the fiber optic wet mate connectors 614 has an optical fiber disposed therein. As illustrated, the three optical fibers associated with fiber optic wet mate holder 614 may pass through a splitter such that they may be housed within a single conduit that extends through a packer disposed below apparatus 400 and is wrapped around sand control screens 48, 50, 52, 54 as described above to obtain distributed temperature information, for example.

The operation of this embodiment of an apparatus for controlling the connection speed of downhole connectors according to the present invention will now be described. After the installation of completion 42 in the wellbore and the performance of any associated treatment processes wherein the optical fibers associated with completion 42 and companion optical fibers associated with the service tool string may deliver information to the surface, the service tool string is retrieved to the surface. In this process, the optical fibers associated with completion 42 and the optical fibers associated with the service tool string must be decoupled. In order to reuse the optical fibers associated with completion 42 during production, new optical fibers must be carried with production tubing string 36 and optically coupled to the optical fibers associated with completion 42.

In the present invention, conduit 444 is attached to the exterior of production tubing string 36 and extends from the surface to the anchor assembly. One or more optical fibers are disposed within conduit 444 which may be a conventional hydraulic line formed from stainless steel or similar material. The anchor assembly is lowered into the wellbore until the seal assemblies on its lower end enter completion 42. As production tubing string 36 is further lowered into the wellbore, orientation guide 434 contacts orientating guide 600. This interaction rotates the anchor assembly to provide a relatively coarse circumferential alignment of fiber optic wet mate head 432 with fiber optic wet mate holder 612. The anchor assembly now continues to travel downwardly in completion 42 until plungers 448, 450 contact surface 628 of top subassembly 608. Further downward motion of the anchor assembly causes plungers 448, 450 to shift longitudinally relative to fiber optic wet mate head 432 and compress springs 452, 454. In addition, this longitudinal movement causes lugs 526, 528 to shift radially inwardly, as best seen in FIGS. 10A-10C and 11A-11C. This action unlocks the inner components of the anchor assembly from the outer components of the anchor assembly. As further downward movement of the inner components of the anchor assembly is now prevented by contact between surface 532 of key assembly 530 and surface 620 of top subassembly 608, weight applied to apparatus 400 causes the outer components of the anchor assembly to shift longitudinally relative to the inner components of the anchor assembly in a telescopic manner.

As continued downward force is placed on the anchor assembly by applying force to the production tubing string 36, upper connector 402 is urged downwardly relative to piston mandrel 500. The movement of upper connector 402 relative to piston mandrel 500 is resisted, however, by a resistance member. In the illustrated embodiment, the resistance member is depicted as transfer piston 508 and the fluid within annular oil chamber 502. Specifically, the speed at which upper connector 402 can move relative to piston mandrel 500 is determined by the size of the orifices within passageways 510 of transfer piston 508 as well as the type of fluid, including liquids, gases or combinations thereof, within annular oil chamber 502. As the downward force is applied to upper connector 402, the fluid from upper section 504 of annular oil chamber 502 transfers to lower section 506 of annular oil chamber 502 passing through passageways 510. In this manner, excessive connection speed of fiber optic wet mate connectors 442 and fiber optic wet mate connectors 614 is prevented.

As best seen in FIGS. 12A-12C and 13A-13C, continued downward force on upper connector 402 not only enables connection of fiber optic wet mate connectors 442 and fiber optic wet mate connectors 614 at a predetermined speed, but also, causes prop member 446 of fiber optic wet mate head 432 to prop locking keys 534 of key assembly 530 in radially reduced section 618 of top subassembly 608 which anchors the inner components of the anchor assembly within completion 42. In addition, this telescopic movement of the outer components of the anchor assembly relative to the inner components of the anchor assembly causes keys 428 to become aligned with annular groove 522 of bottom mandrel 520. In this configuration, keys 428 are released from annular groove 422 of spring housing 418. Once the connection between fiber optic wet mate connectors 442 and fiber optic wet mate connectors 614 is established, light transmission is permitted between the optical fibers therein.

As best seen in FIGS. 14A-14C and 15A-15C, continued downward force applied on upper connector 402 further shifts the outer components of the anchor assembly relative to the inner components of the anchor assembly. In this configuration, the telescopic movement causes locking collets 412 to pass downwardly over annular protrusion 516 of locking profile assembly 514 while spring 420 is being compressed between collet assembly 410 and spring support member 424. Once apparatus 400 is in this configuration, the downward force applied on upper connector 402 may be release such that apparatus 400 will be placed in its production configuration, as best seen in FIGS. 16A-16C and 17A-17C. In this configuration, not only are fiber optic wet mate connectors 442 and fiber optic wet mate connectors 614 coupled together, there is a biasing force created by compressed spring 420 that assures the connections will not be lost. Specifically, compressed spring 420 downwardly biases spring support member 424 which in turn applies a downward force on fiber optic wet mate head 432. This force prevents any decoupling of fiber optic wet mate connectors 442 and fiber optic wet mate connectors 614. In addition, the interaction between locking keys 534 of key assembly 530 and top subassembly 408 prevents separation of the anchoring assembly and the completion 42.

If it is desired to detach production tubing string 36 from completion 42, a significant tensile force must be applied to production tubing string 36 at the surface, for example, 20,000 lbs. This force is transmitted via upper connector 402 and hone bore 404 to collet assembly 410. The upward force acts between surfaces 416 of locking collets 412 and shoulder 518 of locking profile assembly 514. As upward movement of locking profile assembly 514 is prevented by the interaction between locking keys 534 of key assembly 530 and top subassembly 608, upon application of sufficient force, locking collets 412 will release from locking profile assembly 514. Thereafter, the outer portions of anchor assembly that were telescopically contracted can be telescopically extended including the release of energy from spring 420. In order to separate fiber optic wet mate connectors 442 and fiber optic wet mate connectors 614, the outer portions of the anchor assembly must be further shifted relative to the inner portions of the anchor assembly. The rate of the axial shifting is again controlled by the metering rate of fluid through transfer piston 508. To aid in full extension of the outer portions of the anchor assembly relative to the inner portions of the anchor assembly, an optional spring 538 may operate between upper connector 402 and transfer piston 508. As this point the anchor assembly returns to the running configuration as seen in FIGS. 8A-8C and 9A-9C and may be retrieved to the surface or the set down and latch up sequence can be started again.

Figures 18A, 18B, 18C:
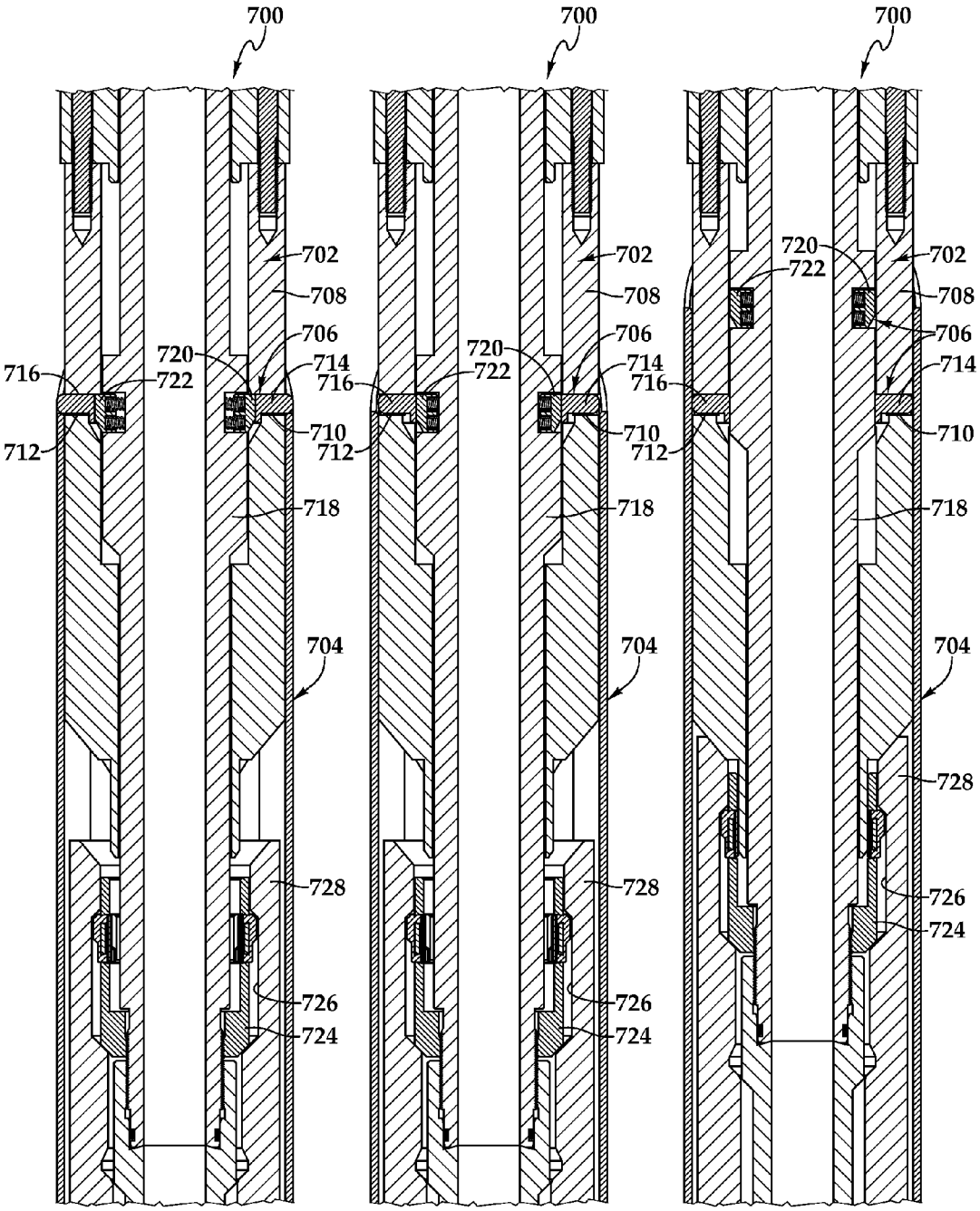
FIGS. 18A-18C are cross sectional views of a lock assembly section of an apparatus for controlling the connection speed of downhole connectors in various configurations according to an embodiment of the present invention.

Referring next to FIGS. 18A-18C, therein is depicted another embodiment of an apparatus for controlling the connection speed of downhole connectors that is generally designated 700. In the portion of apparatus 700 that is depicted, an alternate embodiment of a lock assembly will be described. In the illustrated section, apparatus 700 includes a portion of an anchor assembly 702 and a portion of a completion 704. Apparatus 700 is similar to apparatus 400 described above except for the configuration and operation of the lock assembly 706 that releases the outer components of the anchor assembly 702 from the inner components of the anchor assembly 702. The outer components of anchor assembly 702 include fiber optic wet mate head 708 that has a pair of radially extending openings 710, 712 having lug extensions 714, 716 slidably positioned therein and partially extending radially outwardly therefrom. The inner components of anchor assembly 702 include bottom mandrel 718 having a pair of radially reduces sections with a pair of spring operated lugs 720, 722 received therein. Together, spring operated lugs 720, 722 and lug extensions 714, 716 may be referred to herein as lock assembly 706. The inner components of anchor assembly 702 also include a key assembly 724 that is operable to engage with a profile 726 of top subassembly 728.

In operation, anchor assembly 702 is lowered into the wellbore until the seal assemblies on its lower end enter completion 704. As production tubing string 36 is further lowered into the wellbore, anchor assembly 702 may be orientated relative to completion 704 in a manner similar to that described above. Anchor assembly 702 now continues to travel downwardly in completion 704 until lug extensions 714, 716 reach an upper surface of completion 704 such as an upper surface of the orientation guide, as best seen in FIG. 18A. Further downward motion of the anchor assembly 702 causes lug extensions 714, 716 to shift radially inwardly relative to fiber optic wet mate head 708. In addition, this radial movement causes lugs 720, 722 to shift radially inwardly, as best seen in FIG. 18B. This action unlocks the inner components of the anchor assembly from the outer components of the anchor assembly. As further downward movement of the inner components of anchor assembly 702 is now prevented by contact between key assembly 724 and top subassembly 728, weight applied to apparatus 700 causes the outer components of anchor assembly 702 to shift longitudinally relative to the inner components of anchor assembly 702 in a telescopic manner, as best seen in FIG. 18C, wherein key assembly 724 is propped within profile 726 of top subassembly 728. In addition, this downward movement of the outer components of anchor assembly 702 relative to the inner components of anchor assembly 702 also causes coupling of the associated wet mate components (not visible in FIGS. 18A-18C) in a manner similar to that described above with reference to apparatus 400.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for controlling a connection speed of downhole connectors in a subterranean well:

positioning a first assembly having a first downhole connector and a first communication medium in the well;

engaging the first assembly with a second assembly having a second downhole connector and a second communication medium;

unlocking an outer portion of the second assembly from an inner portion of the second assembly by radially shifting at least one lug;

axially shifting the outer portion of the second assembly relative to the inner portion of the second assembly while metering a fluid through a transfer piston to control the axially shifting speed thereof; and operatively connecting the first and second downhole connectors, thereby enabling communication between the first and second communication media.

2. The method as recited in claim 1 wherein unlocking the outer portion of the second assembly from the inner portion of the second assembly further comprises radially shifting a plurality of lugs.

3. The method as recited in claim 1 wherein unlocking the outer portion of the second assembly from the inner portion of the second assembly further comprises longitudinally shifting a plunger of the second assembly responsive to contact with the first assembly to radially retract the at least one lug.

4. The method as recited in claim 1 wherein unlocking the outer portion of the second assembly from the inner portion of the second assembly further comprises radially retracting the at least one lug responsive to contact between at least one lug extension and the first assembly.

5. The method as recited in claim 1 further comprising anchoring the second assembly within the first assembly by propping a key assembly of the second assembly within a profile of the first assembly.

6. The method as recited in claim 1 wherein axially shifting the outer portion of the second assembly relative to the inner portion of the second assembly further comprises overcoming a biasing force of a spring operably associated with the transfer piston to control the axially shifting speed thereof.

7. The method as recited in claim 1 further comprising resisting disconnection of the first and second downhole connectors by locking the outer portion of the second assembly with the inner portion of the second assembly.

8. The method as recited in claim 7 wherein locking the outer portion of the second assembly with the inner portion of the second assembly further comprises engaging a collet assembly of the outer portion of the second assembly with a shoulder of the inner portion of the second assembly by continuing the axial shifting of the outer portion of the second assembly relative to the inner portion of the second assembly after connecting the first and second downhole connectors.

9. The method as recited in claim 1 wherein the communication media are selected from the group consisting of optical fibers, electrical conductors and hydraulic fluid conductors.

10. A method for controlling a connection speed of downhole connectors in a subterranean well comprising:

positioning a first assembly having a first downhole connector and a first communication medium in the well;

engaging the first assembly with a second assembly, the second assembly including a second downhole connector and a second communication medium, the second assembly having an outer portion and an inner portion that are initially coupling together with a lock assembly;

unlocking the outer portion of the second assembly from the inner portion of the second assembly by radially shifting at least one lug of the lock assembly;

axially shifting the outer portion of the second assembly relative to the inner portion of the second assembly; and operatively connecting the first and second downhole connectors, thereby enabling communication between the first and second communication media.

11. The method as recited in claim 10 wherein unlocking the outer portion of the second assembly from the inner portion of the second assembly further comprises radially shifting a plurality of lugs of the lock assembly.

12. The method as recited in claim 10 wherein unlocking the outer portion of the second assembly from the inner portion of the second assembly further comprises longitudinally shifting a plunger of the lock assembly responsive to contact with the first assembly to radially retract the at least one lug.

13. The method as recited in claim 10 wherein unlocking the outer portion of the second assembly from the inner portion of the second assembly further comprises radially retracting the at least one lug responsive to contact between at least one lug extension of the lock assembly and the first assembly.

14. The method as recited in claim 10 wherein axially shifting the outer portion of the second assembly relative to the inner portion of the second assembly further comprises controlling an axial shifting speed of the outer portion of the second assembly relative to the inner portion of the second assembly with a resistance assembly.

15. The method as recited in claim 14 wherein controlling the axial shifting speed of the outer portion of the second assembly relative to the inner portion of the second assembly further comprises metering a fluid through a transfer piston and compressing a spring operably associated with the transfer piston.

16. The method as recited in claim 10 further comprising anchoring the second assembly within the first assembly by propping a key assembly of the second assembly within a profile of the first assembly.

17. The method as recited in claim 10 further comprising resisting disconnection of the first and second downhole connectors by locking the outer portion of the second assembly with the inner portion of the second assembly.

18. The method as recited in claim 17 wherein locking the outer portion of the second assembly with the inner portion of the second assembly further comprises engaging a collet assembly of the outer portion of the second assembly with a shoulder of the inner portion of the second assembly by continuing the axial shifting of the outer portion of the second assembly relative to the inner portion of the second assembly after connecting the first and second downhole connectors.

19. The method as recited in claim 10 wherein the communication media are selected from the group consisting of optical fibers, electrical conductors and hydraulic fluid.

20. An apparatus for controlling a connection speed of downhole connectors in a subterranean well comprising:

a first assembly positionable in the well, the first assembly including a first downhole connector and a first communication medium;

a second assembly including a second downhole connector and a second communication medium, the second assembly having an outer portion and an inner portion with a transfer piston positioned therebetween, the outer portion selectively axially shiftable relative to the inner portion; and a lock assembly including at least one lug initially coupling the outer and inner portions of the second assembly together;

wherein, upon engagement of the first assembly with the second assembly, the at least one lug is radially shifted to release the lock assembly and allow axial shifting of the outer portion of the second assembly relative to the inner portion of the second assembly; and wherein, a fluid is metered through the transfer piston to control the speed at which the outer and inner portions of the second assembly axially shift relative to one another such that the first and second downhole connectors are operatively connected at a predetermined connection speed, thereby enabling communication between the communication media.

21. The apparatus as recited in claim 20 wherein the lock assembly further comprises a plurality of lugs.

22. The apparatus as recited in claim 20 wherein the lock assembly further comprises a plunger assembly that longitudinally shifts relative to the at least one lug responsive to contact with the first assembly to radially retract the at least one lug.

23. The apparatus as recited in claim 20 wherein the lock assembly further comprises at least one lug extension and wherein the at least one lug is radially retracted responsive to contact between the at least one lug extension and the first assembly.

24. The apparatus as recited in claim 20 wherein the second assembly further comprises a key assembly and the first assembly further comprises a profile, the key assembly operable to be propped within the profile to anchor the second assembly within the first assembly.

25. The apparatus as recited in claim 20 wherein the inner portion of the second assembly further comprises a shoulder and the outer portion of the second assembly further comprises a collet assembly and wherein continued axial shifting of the outer portion of the second assembly relative to the inner portion of the second assembly after connecting the first and second downhole connectors engages the collet assembly with the shoulder to selectively lock the outer portion of the second assembly with the inner portion of the second assembly to resist disconnection of the first and second downhole connectors.

26. The apparatus as recited in claim 20 wherein the communication media are selected from the group consisting of optical fibers, electrical conductors and hydraulic fluid conductor.

27. An apparatus for controlling a connection speed of downhole connectors in a subterranean well comprising:

a first assembly positionable in the well, the first assembly including a first downhole connector and a first communication medium;

a second assembly including a second downhole connector and a second communication medium, the second assembly having an outer portion and an inner portion that are selectively axially shiftable relative to one another; and a lock assembly including at least one lug initially coupling the outer and inner portions of the second assembly together, wherein, upon engagement of the first assembly with the second assembly, the at least one lug is radially shifted to release the lock assembly and allow axial shifting of the outer portion of the second assembly relative to the inner portion of the second assembly; and wherein, the axial shifting of the outer portion of the second assembly relative to the inner portion of the second assembly operatively connects the first and second downhole connectors, thereby enabling communication between the communication media.

28. The apparatus as recited in claim 27 wherein the lock assembly further comprises a plurality of lugs.

29. The apparatus as recited in claim 27 wherein the lock assembly further comprises a plunger assembly that longitudinally shifts relative to the at least one lug responsive to contact with the first assembly to radially retract the at least one lug.

30. The apparatus as recited in claim 27 wherein the lock assembly further comprises at least one lug extension and wherein the at least one lug is radially retracted responsive to contact between the at least one lug extension and the first assembly.

31. The apparatus as recited in claim 27 further comprising a resistance assembly positioned between the outer portion of the second assembly and the inner portion of the second assembly that controls an axial shifting speed of the outer and inner portions of the second assembly relative to one another.

32. The apparatus as recited in claim 31 wherein the resistance assembly further comprises a transfer piston operable to have fluid metered therethrough and a spring operably associated with the transfer piston.

33. The apparatus as recited in claim 27 wherein the second assembly further comprises a key assembly and the first assembly further comprises a profile, the key assembly operable to be propped within the profile to anchor the second assembly within the first assembly.

34. The apparatus as recited in claim 27 wherein the inner portion of the second assembly further comprises a shoulder and the outer portion of the second assembly further comprises a collet assembly and wherein continued axial shifting of the outer portion of the second assembly relative to the inner portion of the second assembly after connecting the first and second downhole connectors engages the collet assembly with the shoulder to selectively lock the outer portion of the second assembly with the inner portion of the second assembly to resist disconnection of the first and second downhole connectors.

35. The apparatus as recited in claim 27 wherein the communication media are selected from the group consisting of optical fibers, electrical conductors and hydraulic fluid conductor.

36. A method for controlling a connection speed of downhole connectors in a subterranean well comprising:

positioning a first assembly having a first downhole connector and a first communication medium in the well;

engaging the first assembly with a second assembly, the second assembly including a second downhole connector and a second communication medium, the second assembly having an outer portion and an inner portion that are initially coupling together;

unlocking the outer portion of the second assembly from the inner portion of the second assembly responsive to contact with the first assembly;

axially shifting the outer portion of the second assembly relative to the inner portion of the second assembly;

operatively connecting the first and second downhole connectors, thereby enabling communication between the first and second communication media; and resisting disconnection of the first and second downhole connectors by recoupling the outer portion of the second assembly with the inner portion of the second assembly.

37. The method as recited in claim 36 wherein unlocking the outer portion of the second assembly from the inner portion of the second assembly further comprises radially shifting at least one lug of a lock assembly.

38. The method as recited in claim 36 wherein unlocking the outer portion of the second assembly from the inner portion of the second assembly further comprises radially shifting a plurality of lugs of a lock assembly.

39. The method as recited in claim 36 wherein unlocking the outer portion of the second assembly from the inner portion of the second assembly further comprises longitudinally shifting a plunger of a lock assembly responsive to contact with the first assembly to radially retract at least one lug of the lock assembly.

40. The method as recited in claim 36 wherein unlocking the outer portion of the second assembly from the inner portion of the second assembly further comprises radially retracting at least one lug of a lock assembly responsive to contact between at least one lug extension of the lock assembly and the first assembly.

41. The method as recited in claim 36 wherein axially shifting the outer portion of the second assembly relative to the inner portion of the second assembly further comprises controlling an axial shifting speed of the outer portion of the second assembly relative to the inner portion of the second assembly with a resistance assembly.

42. The method as recited in claim 41 wherein controlling the axial shifting speed of the outer portion of the second assembly relative to the inner portion of the second assembly further comprises metering a fluid through a transfer piston and compressing a spring operably associated with the transfer piston.

43. The method as recited in claim 36 further comprising anchoring the second assembly within the first assembly by propping a key assembly of the second assembly within a profile of the first assembly.

44. The method as recited in claim 36 wherein recoupling the outer portion of the second assembly with the inner portion of the second assembly further comprises engaging a collet assembly of the outer portion of the second assembly with a shoulder of the inner portion of the second assembly by continuing the axial shifting of the outer portion of the second assembly relative to the inner portion of the second assembly after connecting the first and second downhole connectors.

45. The method as recited in claim 36 wherein the communication media are selected from the group consisting of optical fibers, electrical conductors and hydraulic fluid.

46. An apparatus for controlling a connection speed of downhole connectors in a subterranean well comprising:

a first assembly positionable in the well, the first assembly including a first downhole connector and a first communication medium;

a second assembly including a second downhole connector and a second communication medium, the second assembly having an outer portion and an inner portion that are selectively axially shiftable relative to one another;

a first lock assembly initially coupling the outer and inner portions of the second assembly together; and a second lock assembly operable to recouple the outer and inner portions of the second assembly together, wherein, upon engagement of the first assembly with the second assembly, the first lock assembly is released to allow axial shifting of the outer portion of the second assembly relative to the inner portion of the second assembly;

wherein, the axial shifting of the outer portion of the second assembly relative to the inner portion of the second assembly in a first direction operatively connects the first and second downhole connectors, thereby enabling communication between the communication media; and wherein, continued axial shifting of the outer portion of the second assembly relative to the inner portion of the second assembly in the first direction after connecting the first and second downhole connectors engages the second lock assembly, thereby recoupling the outer portion of the second assembly with the inner portion of the second assembly to resist disconnection of the first and second downhole connectors.

47. The apparatus as recited in claim 46 wherein the first lock assembly further comprises at least one lug.

48. The apparatus as recited in claim 47 wherein the lock assembly further comprises a plunger assembly that longitudinally shifts relative to the at least one lug responsive to contact with the first assembly to radially retract the at least one lug.

49. The apparatus as recited in claim 47 wherein the lock assembly further comprises at least one lug extension and wherein the at least one lug is radially retracted responsive to contact between the at least one lug extension and the first assembly.

50. The apparatus as recited in claim 46 wherein the first lock assembly further comprises a plurality of lugs.

51. The apparatus as recited in claim 46 further comprising a resistance assembly positioned between the outer portion of the second assembly and the inner portion of the second assembly that controls an axial shifting speed of the outer and inner portions of the second assembly relative to one another.

52. The apparatus as recited in claim 51 wherein the resistance assembly further comprises a transfer piston operable to have fluid metered therethrough and a spring operably associated with the transfer piston.

53. The apparatus as recited in claim 46 wherein the second assembly further comprises a key assembly and the first assembly further comprises a profile, the key assembly operable to be propped within the profile to anchor the second assembly within the first assembly.

54. The apparatus as recited in claim 46 wherein the second lock assembly further comprises a shoulder of the inner portion of the second assembly and a collet of the outer portion of the second assembly and wherein continued axial shifting of the outer portion of the second assembly relative to the inner portion of the second assembly after connecting the first and second downhole connectors engages the collet assembly with the shoulder thereby recoupling the outer portion of the second assembly with the inner portion of the second assembly to resist disconnection of the first and second downhole connectors.

55. The apparatus as recited in claim 46 wherein the communication media are selected from the group consisting of optical fibers, electrical conductors and hydraulic fluid conductor.

* * * * *